US005842421A

United States Patent [19]

Desilets et al.

[11] Patent Number: 5,842,421

[45] Date of Patent: Dec. 1, 1998

[54] POWER AND FREE CONVEYOR SYSTEM UTILIZING POWER TRACK AND DOG ELEVATION TO PREVENT JAMMING CONDITIONS AT TRANSFERS AND SWITCHES

[75] Inventors: Dennis W. Desilets, West Bloomfield; Raymond L. Carlson, Munising; Steven J. Dale, Waterford, all of Mich.

[73] Assignee: Ford Motor Company, Dearborn, Mich.

[21] Appl. No.: 682,689

[22] PCT Filed: Aug. 14, 1995

[86] PCT No.: PCT/US95/10344

§ 371 Date: Jul. 30, 1996

§ 102(e) Date: Jul. 30, 1996

[87] PCT Pub. No.: WO96/31380

PCT Pub. Date: Oct. 10, 1996

Related U.S. Application Data

[63] Continuation-in-part of Ser. No. 418,214, Apr. 6, 1995, Pat. No. 5,606,915.

[51] Int. Cl.[6] ..... B61B 3/00

[52] U.S. Cl. ..... 104/172.4; 104/130; 104/250; 104/252

[58] Field of Search ..... 104/172.4, 172.1, 104/172.3, 130.7, 130.01, 250, 252, 249

[56] References Cited

U.S. PATENT DOCUMENTS

| | | | |
|---|---|---|---|
| 3,742,861 | 7/1973 | Wilkinson | 104/172.4 |
| 3,995,561 | 12/1976 | Allor | 104/172.4 |
| 4,058,064 | 11/1977 | Wilder et al. . | |
| 4,073,236 | 2/1978 | Harrington . | |
| 4,073,238 | 2/1978 | Knudsen . | |
| 4,114,538 | 9/1978 | Nicodemus, Jr. et al. . | |
| 4,223,610 | 9/1980 | Lempio | 104/172.4 |
| 4,326,466 | 4/1982 | Parry et al. | 104/172.4 |
| 4,408,539 | 10/1983 | Wakabayashi . | |
| 4,408,540 | 10/1983 | Dehne . | |
| 4,456,117 | 6/1984 | Szczepanski . | |
| 4,461,216 | 7/1984 | Carney . | |
| 4,462,315 | 7/1984 | Wakabayashi . | |
| 4,542,698 | 9/1985 | Wakabayashi | 104/172.4 |
| 4,614,158 | 9/1986 | Helde . | |
| 4,616,570 | 10/1986 | Dehne | 104/172.3 |
| 4,641,583 | 2/1987 | Harrington . | |
| 4,669,388 | 6/1987 | Dehne et al. . | |
| 4,771,700 | 9/1988 | Wakabayashi | 104/172.4 |
| 4,885,997 | 12/1989 | Wakahayashi . | |
| 4,939,999 | 7/1990 | Burt et al. . | |
| 5,058,508 | 10/1991 | Kavieff et al. . | |
| 5,507,233 | 4/1996 | Kwon et al. | 104/172.4 |
| 5,606,915 | 3/1997 | Harris | 104/172.4 |

*Primary Examiner*—Mark Tuan Le
*Attorney, Agent, or Firm*—Marshall & Melhorn

[57] ABSTRACT

A power and free conveyor system is provided which utilizes a difference in height between the wipe in power trolley and the wipe out power trolley, with or without a camming down of a retractable wide dog of the free trolley, to allow the wipe in power chain to wipe in over the retractable dog without any possibility of lateral interference. Thereafter the elevation of the wipe in power trolley and the wipe out power trolley are the same. Improved stop device operating to push down the retractable dog and therefore cause disengagement of the retractable dog from the power chain dog are also provided.

76 Claims, 14 Drawing Sheets

POWER AND FREE CONVEYOR SYSTEM UTILIZING POWER TRACK AND DOG ELEVATION TO PREVENT JAMMING CONDITIONS AT TRANSFERS AND SWITCHES

RELATED APPLICATION

The present application is a continuation-in-part of U.S. patent application Ser. No. 08/418,214, filed Apr. 6, 1995, now U.S. Pat. No. 5,606,915 in the name of Hugh Harris.

BACKGROUND OF THE INVENTION

1. Field of the Invention

The present invention relates generally to a power and free conveying system. More particularly, the present application refers to power and free conveying systems of the type having a wide retractable power dog on the leading free trolley which permits transfer of the propulsion of the leading trolley from a wipe out power chain to a wipe in power chain. Most particularly, the present invention relates to a conveyor system which utilizes the position of a retractable wide dog in relation to the position of a power trolley to prevent jamming at transfer and switch points.

2. Description of the Prior Art

Power and free conveyor systems, both overhead and inverted, have been known in automobile plants and other plants for many years. They are particularly adapted to automotive assembly plants for movement of various components of automobile vehicles. Typically, power and free conveyors are used to convey engines, automobile bodies, and various other components to assembly areas in automotive plants.

A representative power and free conveying system includes a power track, a free track vertically spaced from a power track, a power trolley supported on the power track for movement therealong, and a free trolley to support a load on the free trolley track. The free trolley is engageable and disengageable from the power trolley. The power trolley is typically chain driven to move the free trolley along a free track from one assembly station to another.

In more complex power and free conveyor systems, the capability of providing transfer zones to which a carrier is propelled by a forwarding pusher dog or member, and from which the carrier is to be propelled by a receiving pusher dog or member, are provided. The forwarding and receiving pushers may be part of separately driven forwarding and receiving propelling means, so that carrier speed, or relative spacing, or both, may be varied as desired throughout the system.

There have always been problems in this art when the forwarding, or wipe out, pusher dog is to disengage itself from a retractable dog, and the receiving, or wipe in pusher dog, is then to pick up the retractable dog to transfer a free trolley to the work station. Originally both of these operations could not be performed on the same free trolley, and the receiving or wipe in pusher dog could only be provided on a wipe in chain spaced some distance from the wipe out or forwarding pusher. The wipe in pusher dog could only engage the lead trolley after it was pushed some distance into the transfer zone by the forwarding or wipe out pusher acting on the trailing trolley of a carrier.

While these power and free conveyors worked satisfactorily, and were manufactured by many companies such as Southern Systems, Inc. of Memphis, Tenn.; Midwest Conveyor Company of Kansas City, Kans.; the Jervis B. Webb Company of Farmington Hills, Mich.; and ACCO division of American Chain and Cable, Inc. Of Warren, Mich., the long transfer stations were uneconomical, and took up valuable space. Those skilled in the art continued to search for a way to eliminate them.

The answer to these problems in the art was the advent of the wide dog power and free conveyor system, such as that disclosed in U.S. Pat. No. 4,616,570 to Clarence A. Dehne, and assigned to the Jervis B. Webb Company of Farmington Hills, Mich. For the first time, the transfer could take place entirely on the leading free trolley, eliminating the need for the long transfer sections.

However, the ability to do this depended upon careful alignment of anti-jam cam surfaces on the forwarding pusher, the receiving pusher, and the wing portions of the driving dog of the free trolley. If these were not aligned just right, if dirt affected the positions of the cam surfaces, or a tolerance stack up misaligned the surfaces, jamming conditions could still occur. Also, because of the anti-jam cam surfaces, positive pickup of the receiving pusher dog is not assured. Thus, those skilled in the art continued to search for a way to provide a power and free conveyor that did not depend on close alignment of anti-jam cam surfaces.

SUMMARY OF THE INVENTION

In order to provide a solution to the above problems long standing in the art, a power and free conveyor system is provided which utilizes a difference in height between the wipe in power trolley and the wipe out power trolley, with or without a "camming down" of the retractable wide dog of the free trolley, to allow the wipe in power chain to wipe in over the retractable dog. This allows the power chain to be in proper position for engagement with the free trolley, all without any possibility of a lateral jamming of the wipe in pusher dog with the retractable dog.

In one embodiment of the present invention, there is provided a power and free conveying system of the type having a wipe in power chain, a wipe out power chain, and a free track spaced vertically from both said wipe in power chain and said wipe out power chain. A free trolley having a retractable dog is supported on said free track for movement therealong. At a transfer or switch, the elevation of said wipe in power chain is made sufficiently different from the elevation of the wipe out power chain to allow said wipe in power chain to wipe in over said free trolley without engaging said retractable dog of said free trolley. All that is necessary for this embodiment of the invention to work is for the wipe in power chain and wipe out power chain to travel a sufficient distance to effect the transfer. When the wipe in power chain drops back to the elevation of the wipe out power chain, the wipe in pusher dog will engage the retractable dog of said free trolley to power the same.

In another embodiment of the present invention, there is provided a power and free conveyor of the type having at least one chain to chain transfer. The conveyor includes a wipe in power chain having a wipe in pusher dog, a wipe out power chain having a wipe out pusher dog, and a free trolley having a multi-position, retractable, wide dog supported on a free track spaced vertically from the wipe in power chain and the wipe out power chain for movement along said free track when said free trolley is engaged by said wipe in power chain or said wipe out power chain. A cam down bar is provided at said transfer portion of said power and free conveyor and acts on the wide dog at said transfer portion to move said wide dog from a first extended position to a second or "cammed down" position. At the same time, the elevation of said wipe in power chain at said transfer or switch portion of said power and free conveyor is made greater than the elevation of said wipe out power chain. This allows the wipe in pusher dog to wipe in over said retractable wide dog while said wide dog is in its retracted, or cammed down, position without engaging the retractable dog. The retractable dog will return to its first extended position after passing out from under said cam down bar and be partially engaged by said wipe in pusher dog. The elevation of said wipe in power chain thereafter drops to the elevation of said wipe out power chain and the power dog is fully engaged by the wipe in power dog. The camming down of the retractable dog eliminates the need for the wipe in power chain and the wipe out power chain to travel together an extended distance to make the transfer. It also eliminates a problem which may occur in the previously described embodiment, that of jamming if one of the chains is stopped.

In a still further embodiment of the present invention, an inverted power and free conveyor is provided having the foregoing advantages.

Therefore, it is an object of the present invention to provide an improved power and free conveyor of the wide dog type utilizing the relative positions of the retractable wide dog and the power chains to provide for transfers on the leading free trolley of a carrier whereby jamming conditions are eliminated.

Yet another object of the present invention is to provide a free trolley having a retractable wide dog with increased dog bite and multi-position capability.

Another object of the present invention is to provide a power and free conveyor free trolley having a multi-position retractable dog having a first or fully extended position, a second partially retracted or cammed down position and a third accumulating position.

Further objects and advantages of this invention will be apparent from the following description and dependent claims, reference being made to the accompanying drawings forming a part of the specification, wherein like reference characters designate corresponding parts in the several views.

It is to be understood that the present invention is not limited in its application to the details of construction and arrangements of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

DESCRIPTION OF THE PREFERRED EMBODIMENT

The description of the preferred embodiment of the present invention shows an overhead power and free conveyor utilizing engine carriers of the type that might be found in an automotive plant. From the description, it will be easily understood that the present invention can be used in other than automotive plants and, indeed, anywhere where its ability to carry loads overhead can be utilized. It can also be understood that the present invention can be constructed in an inverted position for use in an above ground or in ground conveying systems, and be well within the scope of the present invention.

Figure 1:
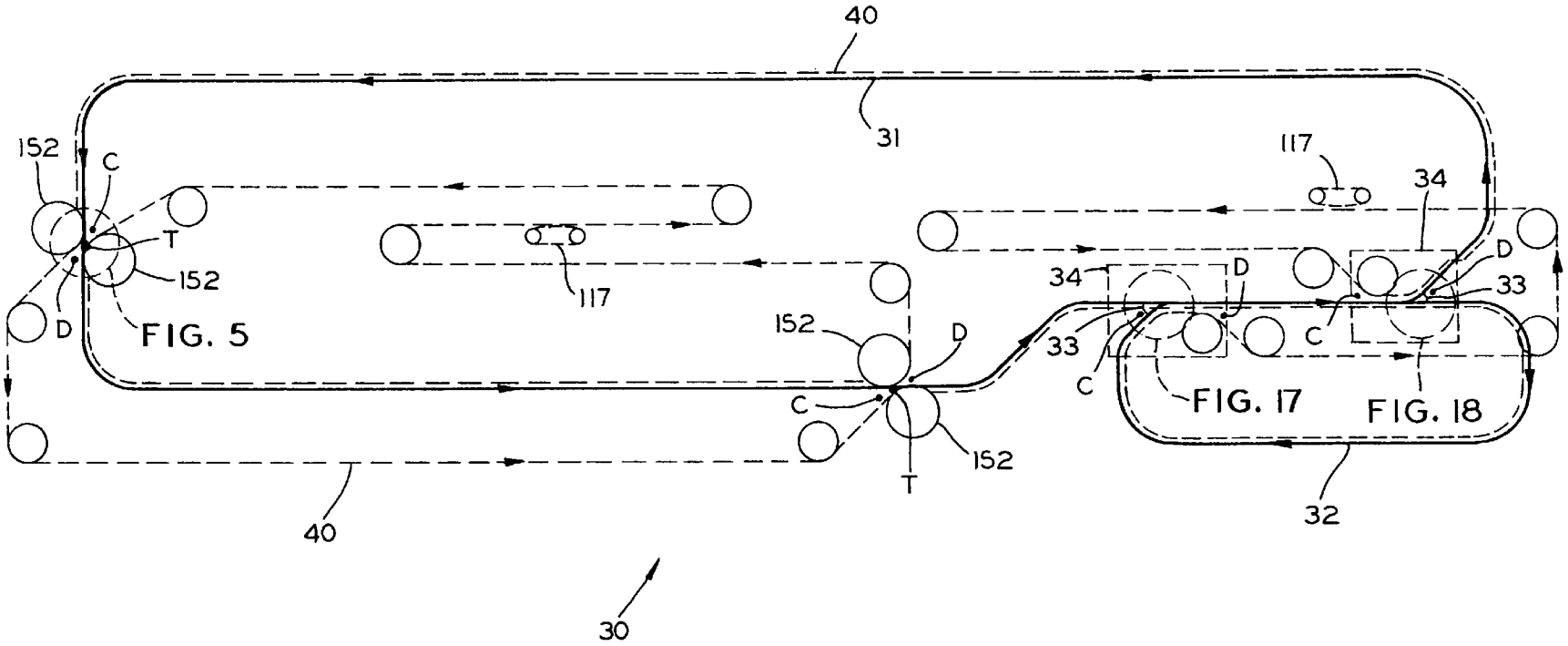
FIG. 1 is a diagrammatic plan view of a representative conveyor system embodying the construction of the present invention.

Referring to FIG. 1, there is shown an overhead power and free conveying system, generally designated by the numeral 30, embodying the construction of the present invention. The power and free conveyor system may have a first or main free trolley track indicated by the numeral 31, and shown in a solid heavy line.

Depending on the number and type of work stations or storage lines present in the system, the power and free conveyor system 30 may also have one or more second or branch trolley tracks shown as a heavy line, and indicated by the numeral 32. Switches 33, carried in switch frames 34, provide entry and exit into the branch free trolley track 32. Branch free trolley tracks 32 are utilized to carry engines or other work pieces past work stations where the speed through the work station may be the same as the speed of travel in the overhead power and free conveyor system 30. If a work station is present wherein the speed of travel must be different than the speed of travel through the remaining portions of the power and free conveyor system 30, a separate power chain to be described below, may be used.

Figure 5:
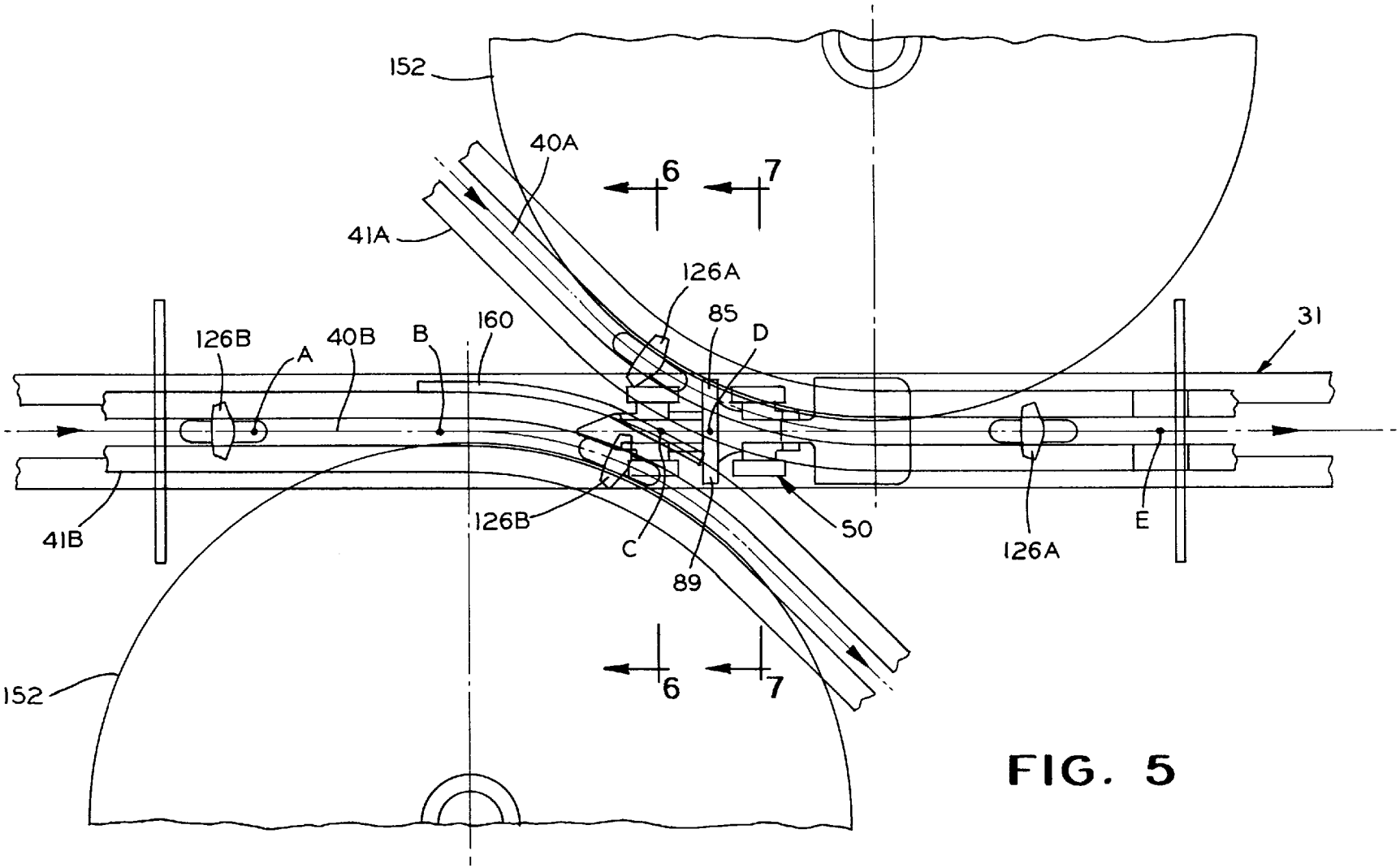
FIG. 5 is an enlarged plan view of the transfer mechanism of the power and free conveying system shown in the view circle 5 of FIG. 1.

In FIG. 1 the power chains are shown in dotted lines and indicated by the numeral 40. As will be described further hereinbelow, the power chains are of two types, a wipe in power chain indicated by the numeral 40A (FIG. 5), and a wipe out power chain indicated by the numeral 40B (FIG. 5).

Figure 2:
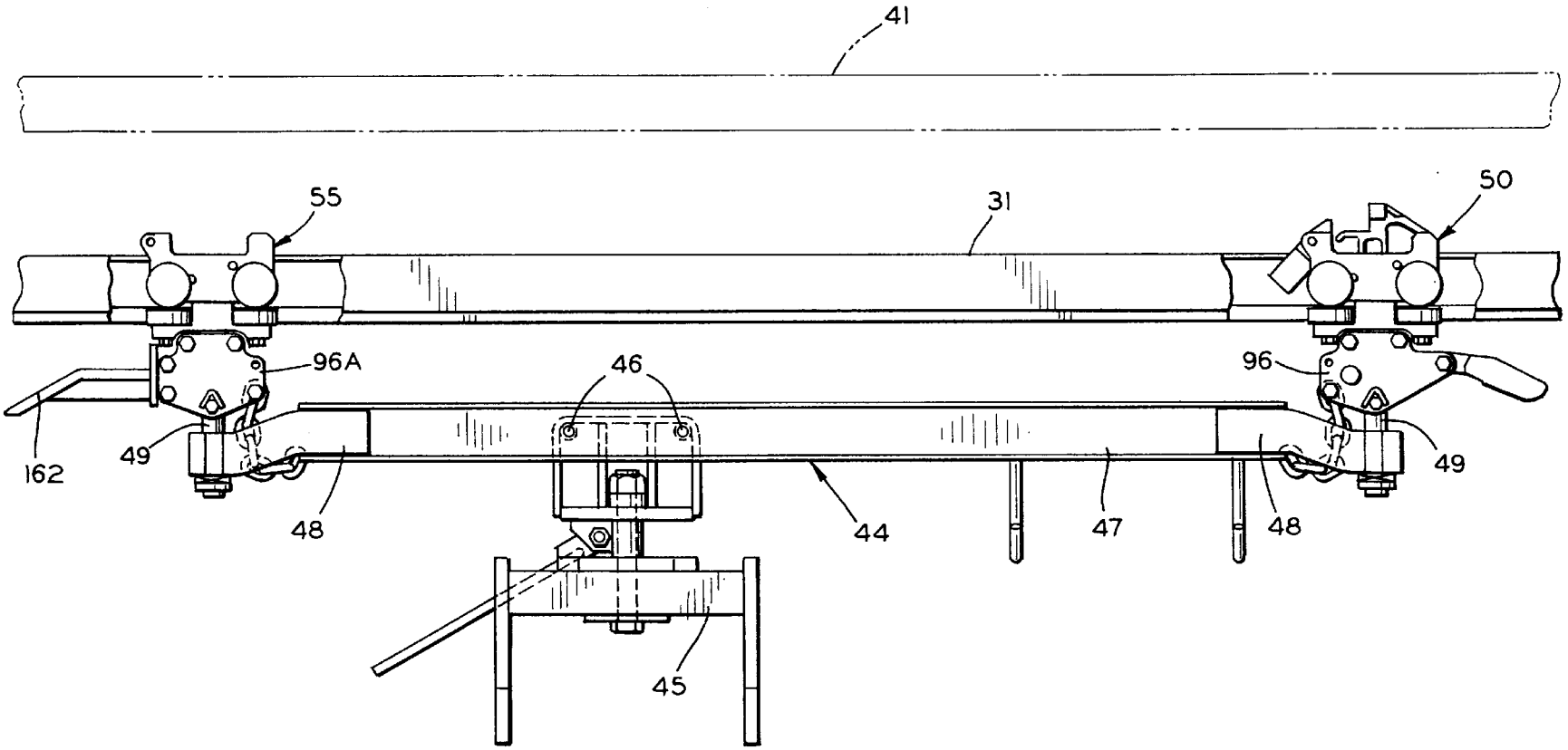
FIG. 2 is an elevational view of a load or engine carrier such as may be used in the construction shown in FIG. 1, with the power track shown in phantom lines.
Figure 3:
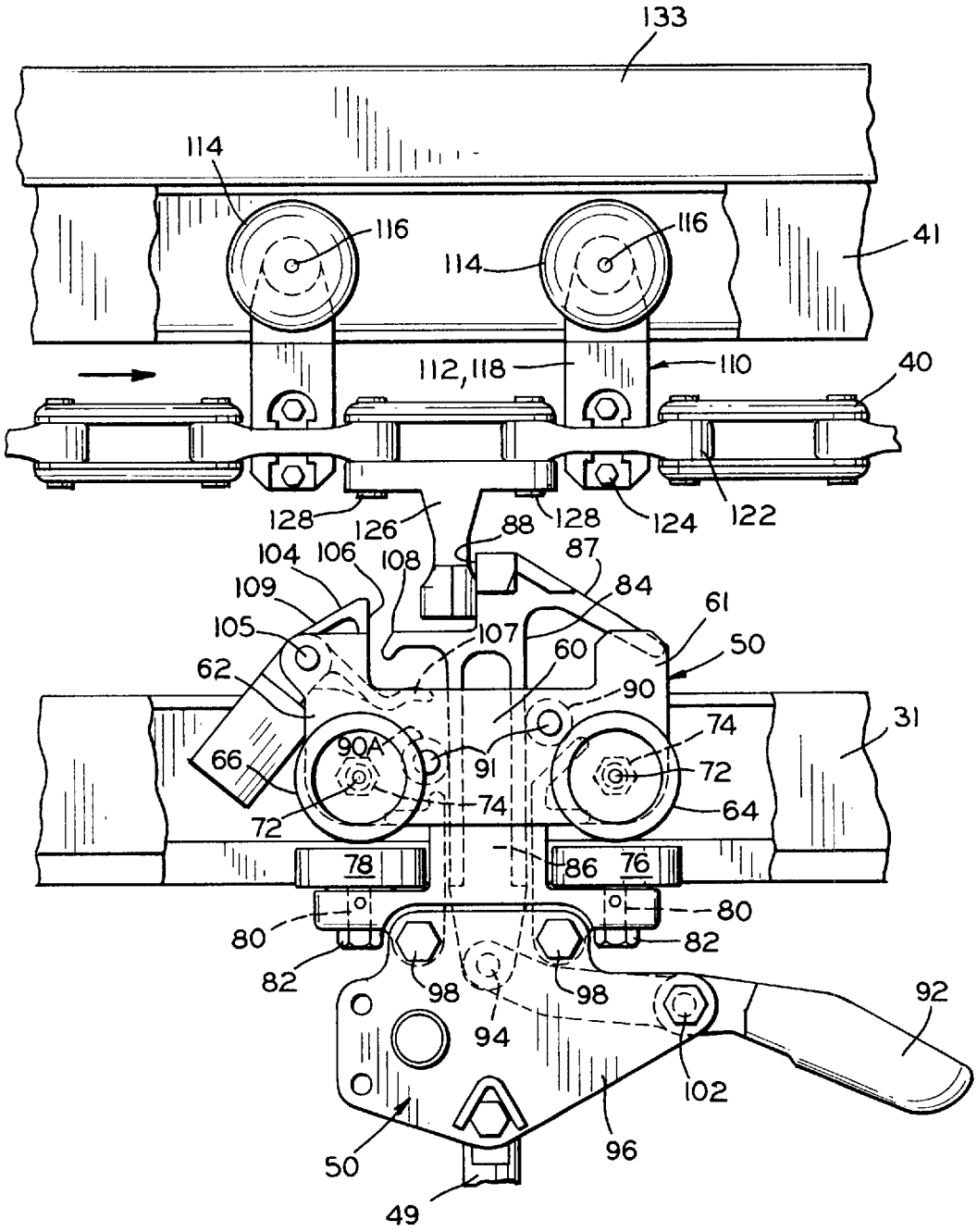
FIG. 3 is an enlarged fragmentary side elevational view of the front or free trolley utilized in the construction shown in FIG. 2.

The power chains 40 are carried on a power trolley track 41 above the free trolley track 31 shown in FIG. 3 and spaced vertically therefrom. Mounted for travel along the free trolley track 31 may be such as an engine carrier assembly generally designated by the numeral 44 (FIG. 2) and consisting of an engine carrier 45 mounted by a pair of rocker pivots 46 to a beam 47. At each end of the beam 47 is provided an adapter 48. The adapter 48 is mounted to a king pin 49 which is attached either to the leading free trolley generally designated by the numeral 50 or the trailing free trolley generally, designated by the numeral 55.

Referring now to FIG. 3, the construction of the leading free trolley 50 may be seen in greater detail. The free trolley 50 has a trolley body 60 which has a pair of transversely spaced first upstanding projections 61 and a pair of transversely spaced second upstanding projections 62 spaced longitudinally from the first upstanding projections 61 at the upper end of the trolley body 60.

Figure 4:
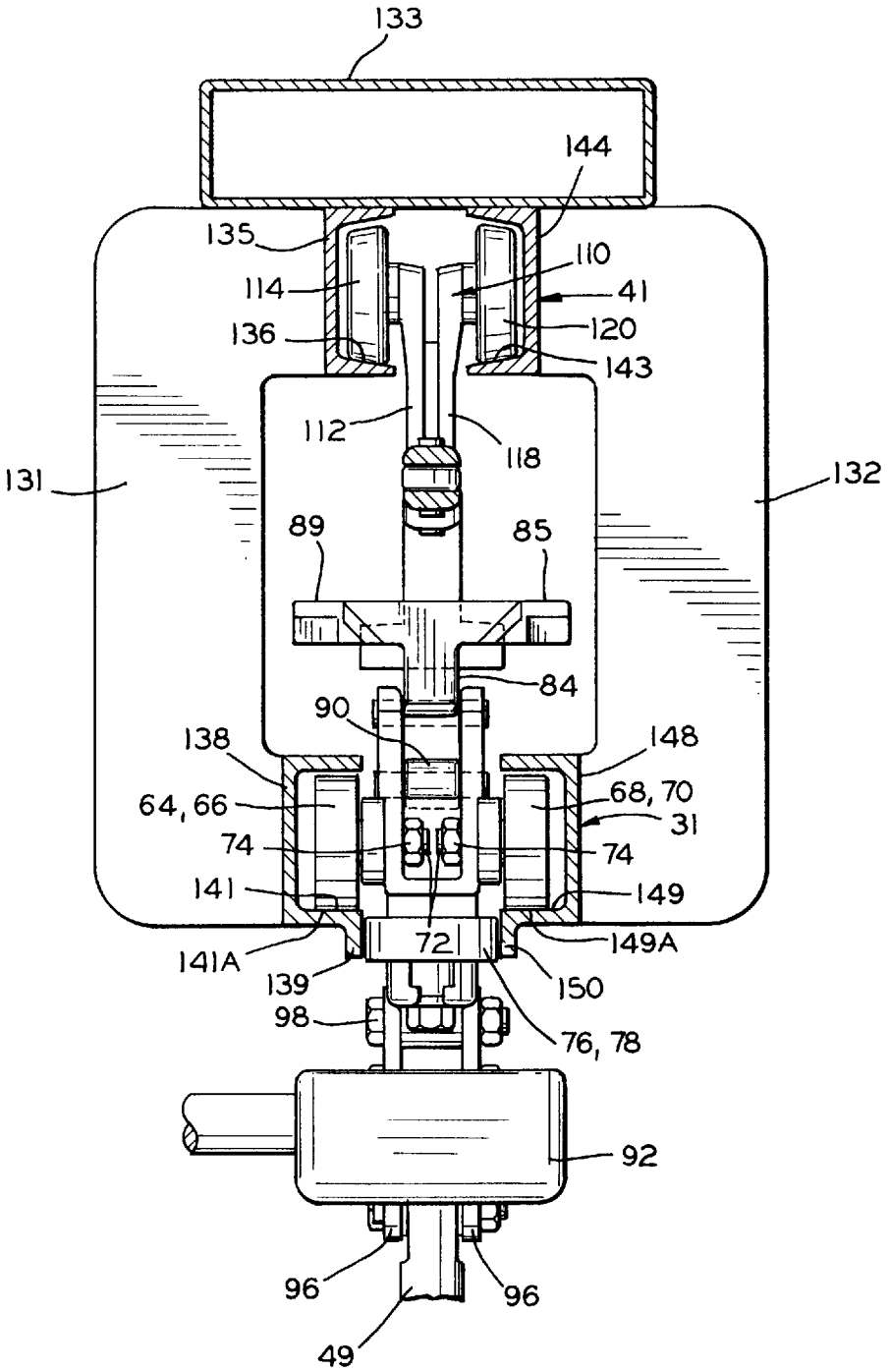
FIG. 4 is a end elevational view of a the power and free trolley shown in FIG. 3.

As shown in FIG. 4, the forward free trolley 50 includes forward and rear first free trolley wheels, 64 and 66 respectively, for engaging the first free track member 138, and forward and rear second free trolley wheels 68 and 70 respectively for engaging the second free track member 148. In the illustrated embodiment of the invention, each of the trolley wheels 64,66 and 68,70 has a flat face 141A,149A to engage the track surfaces 141 and 149 respectively of the first free track member 138 and second free track member 148 and eliminate track spreading forces. However it can be understood in the art that, if desired, the more commonly available steel channel may be used which has inner tapered surfaces and in this instance the flat faces may be tapered to match the inner surfaces of the first free track member and second free track member.

Each of the free trolley wheels 64,66,68, and 70 are of the ball bearing type having a shaft 72 extending transversely through the trolley body 50, and secured by nut 74. It should also be appreciated that the free trolley wheels 64,66,68 and 70 are easily removable from the free trolley 50. It can easily be understood by those skilled in the art that the rollers 64,66,68 and 70 do not need to be of a ball bearing type, but may be of any type desired which has the appropriate load carrying capacity.

The free trolley 50 may include forward and rear side guide rollers 76 and 78 respectively disposed between the down standing flanges 139,150 for engaging the down standing flanges of the first and second free track members 138,150 respectively. Each of the side guide rollers 76,78 may also be of the ball bearing type having a shaft 80 (FIG. 5) extending downwardly through the trolley body 60 and secured thereto by the nuts 82. It should be appreciated that the side guide roller 76,78 are removable for ease of maintenance.

The leading free trolley 50 also includes a retractable dog 84 having a leg portion 86 extending downward through the trolley body 60. The retractable wide dog 84 has a cam face 87 which may be engaged by the pusher dog 126 if the free trolley overruns the pusher dog. The driving face 88 is engaged by the chain pusher dog 126 to be described. The retractable wide dog 84 also has wing portions 85 and 89 extending transversely a predetermined width to provide an increased area for transverse pusher dog engagement.

The leg portion 86 of the retractable wide dog 84 is disposed between a front force guide roll 90 and a rear force guide roll 90A, to prevent longitudinal movement thereof. The guide rolls 90,90A are rotatably secured to the trolley body 60 by pins 91. It can be understood that any suitable means may be used to rotatably secure the guide rolls 90,90A to the trolley body 60. The rolls 90, 90A prevent the retractable wide dog 84 from sticking in a retracted position, which could occur if the dog 84 were guided by sliding surfaces.

The leading free trolley 50 further includes an actuating lever or counter weight 92 rotatably secured by a fastening means 94 to a lower portion of the leg portion 86. The leading free trolley 50 includes a pair of side plates 96 secured to the trolley body 60 by suitable fasteners 98. The counter weight 92 is rotatably secured between the side plates 96 by suitable means such as the fastener 102. It should be appreciated that when the counter weight 92 is moved upwardly in a manner to be described, the leg portion 86 moves downwardly to cause the retractable wide dog 84 to be retracted.

The leading free trolley also includes a hold back dog 104 rotatably secured between the second transversely spaced upstanding projections 62 by any suitable fastening means, such as a fastener 105. The hold back dog 104 has a dog portion 106 which may engage a pusher dog 126 to be described. The hold back dog 104 also has an actuation flange 107 which may be engaged by a corresponding actuator flange 108 of the leg portion 86 of the retractable wide dog 84. The hold back dog 104 also has a cam surface 109 which acts to rotate the holdback dog 104 downwardly if overtaken by a pusher dog 126. It can be seen that the retractable wide dog 84, and the hold back dog 104, allow the leading free trolley 50 to resist disengagement from the chain pusher dog 126.

The construction of the trailing free trolley 55 (FIG. 2) is similar in several respects to the leading free trolley. Many identical parts are used. The trolley body 60 is identical, as are the forward and rear first free trolley wheels 64 and 66 respectively. The forward and rear second free trolley wheels 68 and 70 may also be identical as are the securing means therefore. The forward and rear side guide rollers 76 and 78 are identical as are the attachment means therefore 80, 82. The side plates 96A (similar to side plates 96) are used, and a king pin 49 is mounted thereto. However, absent from the trailing rear trolley 55 are the counter weight 92 and the retractable wide dog 84. Also absent is the hold back dog 104. However, added to the trailing rear trolley, and not found on the leading free trolley 50, is the cam actuator 162 which is used to accumulate the trolleys, as will be further explained below.

The overhead power and free conveyor system 30 includes a plurality of power trolleys (FIGS. 3–4), generally indicated by the numeral 110, for movement along the power track assembly 41. The power trolley 110 includes a first power trolley support 112 having a first power trolley wheel 114 rotatably secured to an upper portion thereof by suitable means such as axle 116. The power trolley 110 also includes a second power trolley support 118 spaced transversely from the first power trolley support 112 and having a second power trolley wheel 120 rotatably secured to an upper portion thereof by a suitable means such as axle 116.

The power trolley 110 also includes a chain 122 for engaging the power trolley supports 112,118. The power trolley supports 112,118 extend through the chain 122 and are secured to each other by suitable means such as the fasteners 124 above and below the chain 122. The power chain 40 also includes a chain pusher dog 126 disposed between a pair of power trolleys 110, and secured to the chain 122 by suitable means such as fasteners 128. The chain pusher dog 126 engages the retractable wide dog 84 to move the free trolley 50 along the free track assembly 31. It should be appreciated that the chain 122 is driven by a power source 117 (FIG. 1) to move the chain assembly 40 along the power track assembly 41.

Except at transfer points or switch points, the free trolley track 31 is held in a vertically spaced axially aligned relationship with the power trolley track 41 by a plurality of first side support members 131 disposed along and secured to the upper support member 133. The first side support member 131 has a generally C-shaped cross-section and is secured to the upper support member 133 by suitable means such as welding. Also utilized a plurality of second side support members 132 spaced transversely from the first side support members 131 and disposed along and secured to the upper support member 133 opposite the first side support member 131. The second side support members 132 have a generally C-shaped cross-section and are secured to the upper support member 133 by suitable means such as welding.

The first side support member 131 includes an upper power track or rail 135 forming a portion of the power trolley track 41 mounted at a transverse end of an upper portion thereof. The upper power track member or rail 135 has a generally C-shaped cross-section with an interior wheel engaging or track surface 136 on a lower portion thereof for engagement by first power trolley wheel 114. The first side support member 131 also includes a first or lower free track member 138 forming a portion of the free trolley track 31. The first free track member 138 may be identical in cross-section to the upper power track member 135, or as illustrated in the preferred embodiment hereof, may have a down standing flange 139 at the lower portion thereof.

The second side support member 132 includes a second or upper power track member 144 forming a portion of the power trolley track 41 at a transverse end of an upper portion thereof and spaced transversely from the first or upper power track member 135. The second power track member 144 has a generally C-shaped cross-section and is a mirror image of the first or upper power track 135. The second power track member 135 has an interior wheel engaging or track surface 143 for engagement by the power trolley wheels 120 previously described.

The second side support member 132 also includes a second or lower free track member 148 at a transverse end of a lower portion thereof and spaced transversely from the first free track member 138. The second free track member 148 has a generally C-shaped cross-section with a flat interior wheel engaging or track surface 149 on the lower portion thereof for engagement by the free trolley wheels 68,70 previously described. The second free track member 148 also has a down standing flange 150 at a transverse end of the lower portion thereof. The forward side guide roller 76 and the rear side guide roller 78 previously described are constrained by the down standing flanges 139,150 to guide the free trolley 50. It should be appreciated that the width of the free track is greater than the width of the power track for increased stability, and that the track members 135,144,138 and 148 may be different as shown, or may be all interchangeable.

Referring now to FIGS. 1 and 5, the improved operation of the present invention may be appreciated. Jamming conditions in power and free conveyor systems, which the present invention eliminates, can occur either at transfer positions indicated at T in FIG. 1 where a free trolley 50 is being transferred from one power chain to another, or where a free trolley 50 is being switched from a first or free trolley track 31 to a second or branch free trolley track 32 by means of switches 33. At each of the transfer or switch points there is a converging portion of the conveyor system indicated at C, followed by a diverging portion of the conveyor system indicated at D. It has been the problem of jamming at the converging portion C of the conveyor which has constantly been a problem for those in the art.

As hereinbefore mentioned, before the advent of the wide dog conveyor systems, long transfer portions were needed because the transfer could not take place on the same trolley. With the advent of the wide dog on a leading trolley, the pick up and transfer could take place on the same trolley as long as certain anti-jam cam surfaces were carefully aligned. The problem of jamming is completely eliminated with the present invention by use of a multi-position retractable dog in combination with a varying in elevation of the power trolley tracks.

FIG. 5 is an enlarged view of the transfer area indicated in FIG. 1, and rotated 909. For ease of understanding, in describing FIGS. 5 through 11, the free trolley track will be consistently referred by the numeral 31. The power trolley track, instead of being referred to by the numeral 41, will now be referred to by the numeral 41A for the wipe in or receiving power trolley track, and 41B for the wipe out or forwarding power trolley track.

It is the relationship of the position of tracks 41A,41B to the position of the wide pusher dog 84, as it may be operated on by the cam means or cam bar 160 to be described hereinafter, which eliminates the jamming possibilities in the present invention.

The predetermined position of the cam down bar 160 with regard to the wipe out power chain 40B may vary somewhat as long as its function is performed. In the illustrated preferred embodiment, the cam down bar 160 starts just to the left of the tangent line of the traction wheel 152. It needs to follow the perimeter of the traction wheel 152 far enough to insure that the leading free trolley 50 has passed the interference zone wherein the chain or pusher dog 126 could strike the side of the wing portion 85 of the retractable wide dog 84 if it were not being held down by the cam bar 160.

Figure 17:
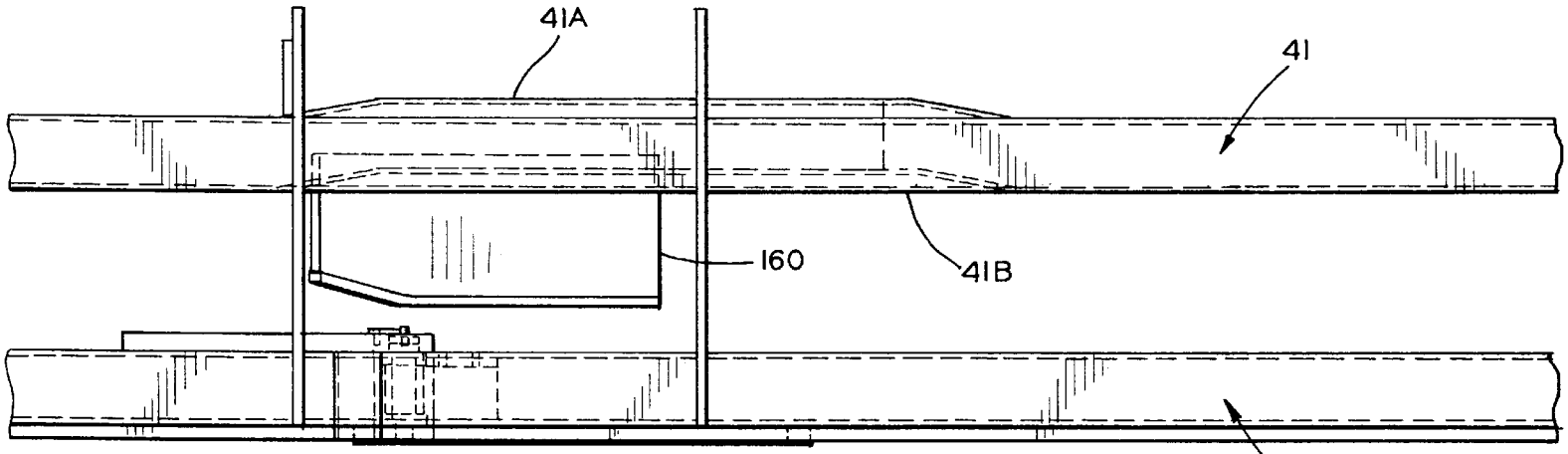
FIG. 17 is a fragmentary elevational view of the switch shown in the view circle 17 of FIG. 1.

The same design considerations concerning the "interference zone" and the cam bar must also be addressed at the switches 33. Referring to FIG. 17 there is shown an elevational view of a merge or entrance switch. The general arrangements of switches for power and free conveyors are well known in the art and need not be discussed herein in detail. It is important to note that in the vicinity of the cam bar 160 the elevation of the wipe in power trolley track 41A is higher than the elevation of the wipe out power trolley track 41B. As before the cam bar 160 extends for a predetermined distance great enough to permit the wipe in power dog 126A (not shown) to wipe in over the top of the retractable dog 84 (not shown) to avoid any possible interference.

Figure 18:
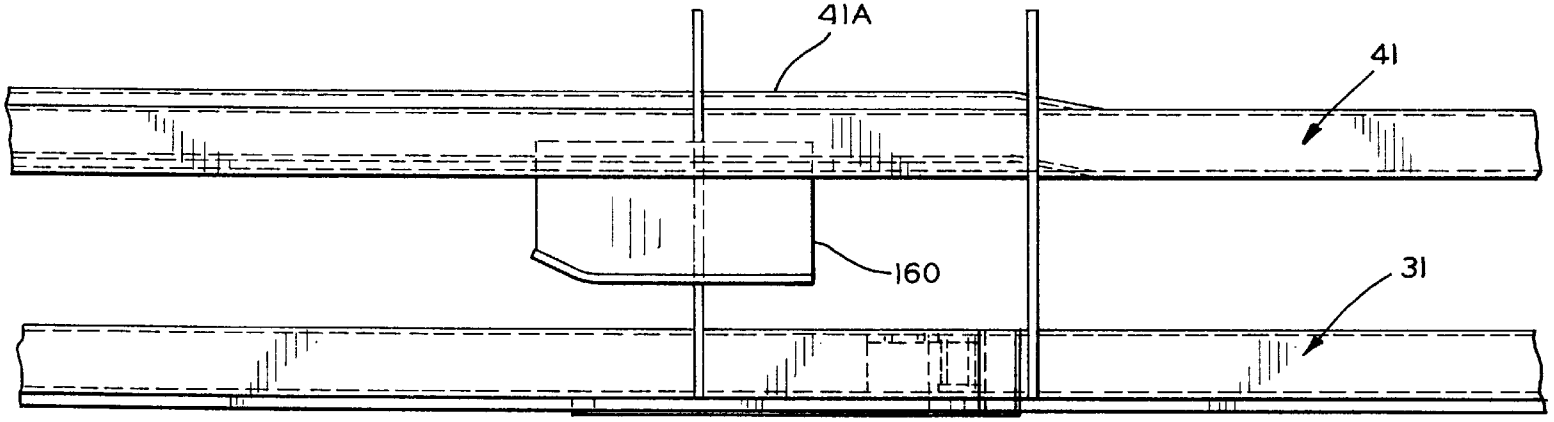
FIG. 18 is a fragmentary elevational view of the switch shown in the view circle 18 of FIG. 1.

Likewise, referring to FIG. 18 the same considerations apply to the diverge or exit switch shown.

The cam bar 160 extends for a predetermined distance so that the wipe in pusher dog (not shown) on the wipe in trolley track 41A will wipe in over the retractable dog 84 (not shown) while the retractable dog is being held down by the cam bar 160. The cam down bar 160 will not release the retractable dog until the interference zone is past. It should be noted with regard to FIGS. 17 and 18 that the cam down bar is curved in FIG. 17 and straight in FIG. 18. In all applications where the cam down bar is curved such as at the transfer zone previously described, the relationship between the elevation of the retractable dog 84 and the hold back dog 104 becomes important, as the hold back dog must also wipe completely under the cam down bar 160 when it is curved. In the illustrated preferred embodiment of the present invention the elevation of the hold back dog is 1⅛" lower than the top of the retractable dog so that when the retractable dog is pushed down 1" by the cam down bar the top of the hold back dog is ⅛" below the top of the retractable dog so that it may wipe under the cam down bar 160. Since the cam bar can be straight or curved depending on the application, this design consideration must be taken into account whenever a curved cam down bar 160 is used.

Figure 6:
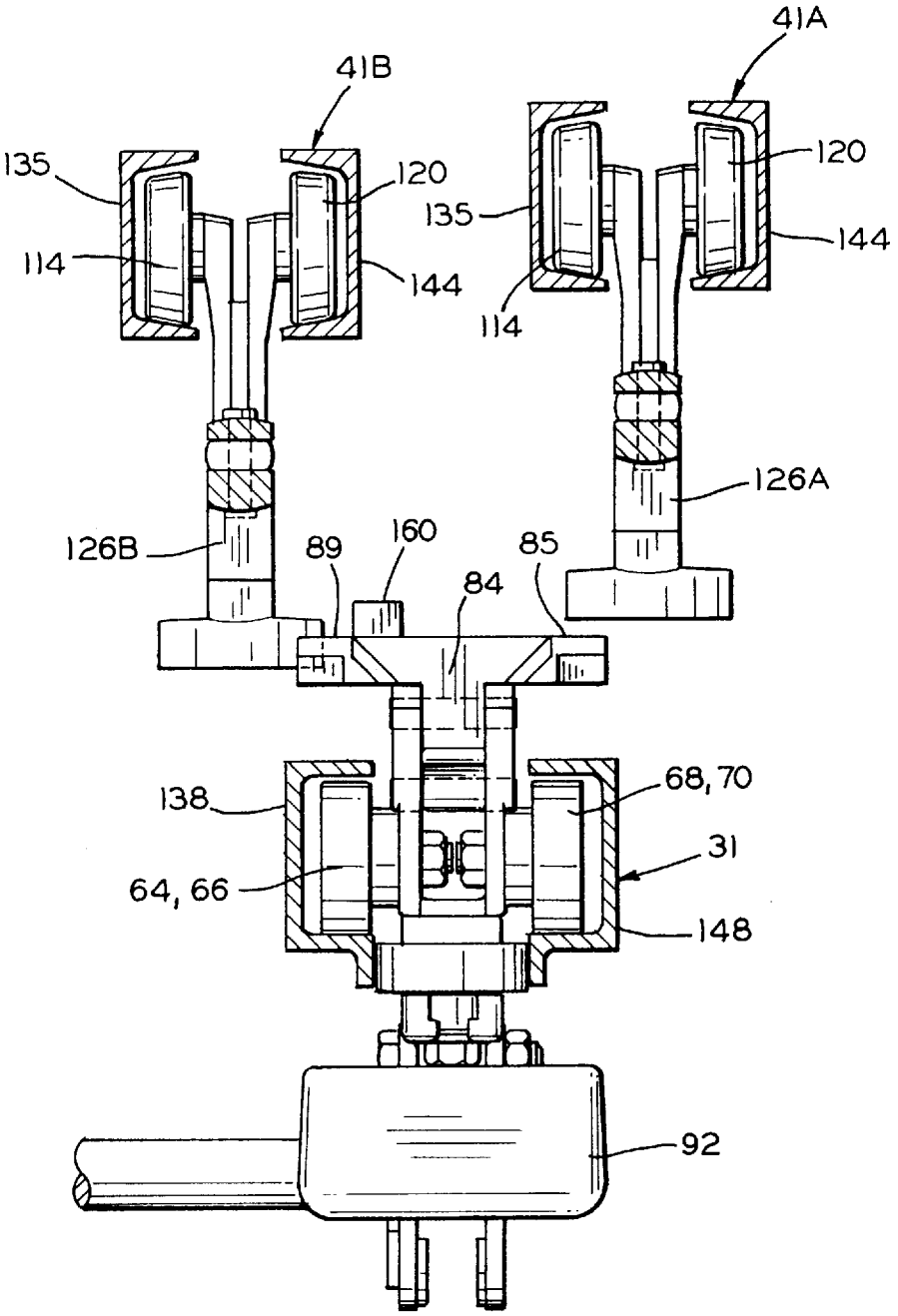
FIG. 6 is a sectional view taken, in the direction of the arrows, along the section line 6—6 of FIG. 5, when the free trolley is under the cam bar.

Referring to FIG. 6 the relative positions of the wipe in power trolley track 41A, the wipe out power trolley track 41B, and the free trolley track 31 are shown just before the end of the cam down bar 160. It can be seen at this point that the wipe in chain pusher dog, which will now be identified hereinafter by the numeral 126A for clarity, has already come in over the top of the wing portion 85 of the retractable wide dog 84. At this point, of course, the interference zone has been passed, and once the cam bar 160 ends, the wipe in pusher dog 126A will either be behind or on top of the wide dog 84, and no jamming can occur.

Figure 7:
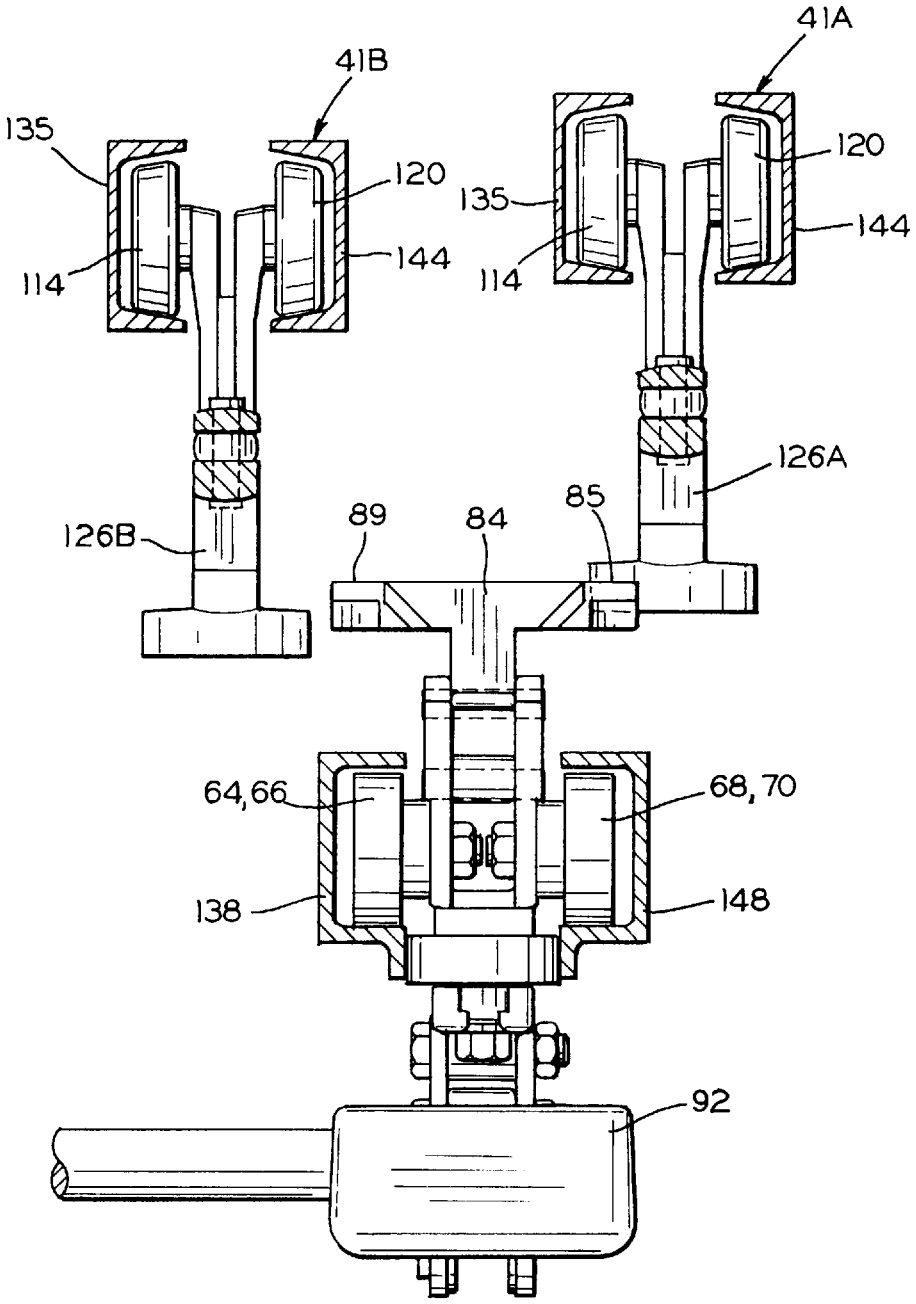
FIG. 7 is a sectional view, taken in the direction of the arrows, along the section line 7—7 of FIG. 5.

Referring now to FIG. 7, the free trolley 31 is shown in a position immediately past the end of the cam bar 160 where the retractable dog 84 has returned to its non "cammed down position", and by virtue of being 1" higher, now has a ⅝" bite on the wipe in chain pusher dog 126A, which is the minimum industry standard. This has occurred while the wipe out chain dog 126B has moved laterally sideways outside the position where any interference is possible between it and the wide cam dog 84.

A complete understanding of the invention is now possible by referring to FIG. 5 in combination with FIGS. 8–12 which illustrate the free trolley 31 at the positions indicated by the letters A–E in FIG. 5. FIGS. 6 and 7 may also be referred to as needed.

Figure 8:
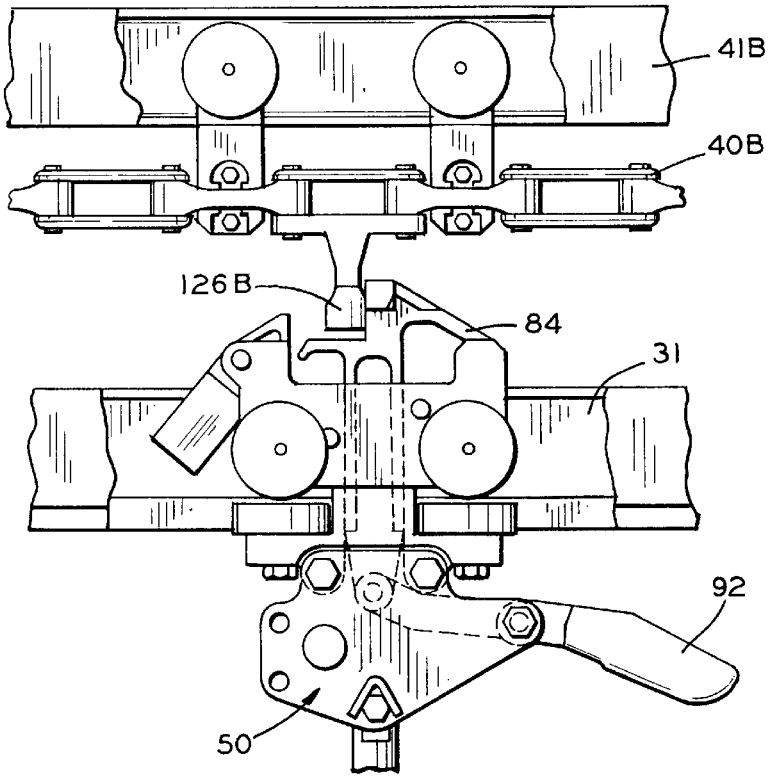
FIG. 8 is a fragmentary elevational view of the free trolley shown in FIG. 3 when it is at the position A indicated in FIG. 5.

Referring now to FIG. 8 (indicated at the position A of FIG. 5) the wipe out power trolley track 41B is vertically spaced a distance from the free trolley track 31 which allows the wipe out chain pusher dog 126B to have a full 1⅝" bite on the adjustable wide dog 84, which is much greater than the industry standard. This is made possible by the increased stroke of the wide dog to be described hereinafter.

Figure 9:
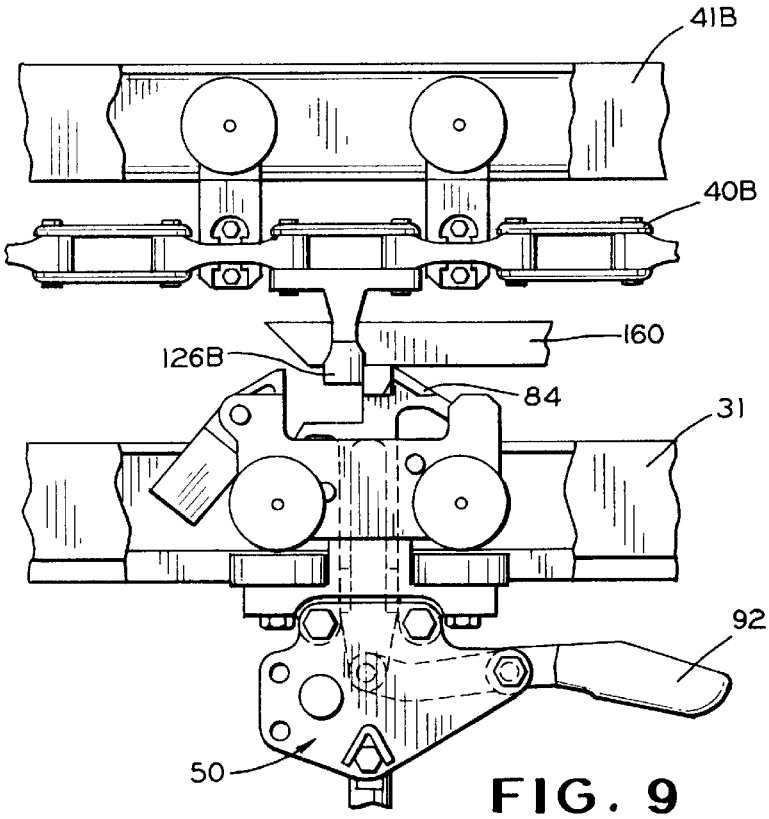
FIG. 9 is a fragmentary elevational view of the free trolley shown in FIG. 3 when it is at the position B indicated in FIG. 5.

FIG. 9 (indicated at position B in FIG. 5) shows the leading free trolley 50 and the free trolley track 31 at a position wherein the adjustable wide dog 84 has just been depressed 1" by the cam down bar 160, allowing only a ⅝" bite between the wipe out chain pusher dog 126B and the retractable wide dog 84. Although these dimensions may vary slightly, it is felt in the industry that a ⅝" bite is the minimum practical bite to prevent any operational problems between the pusher dog 126B and the retractable dog 84.

Figure 10:
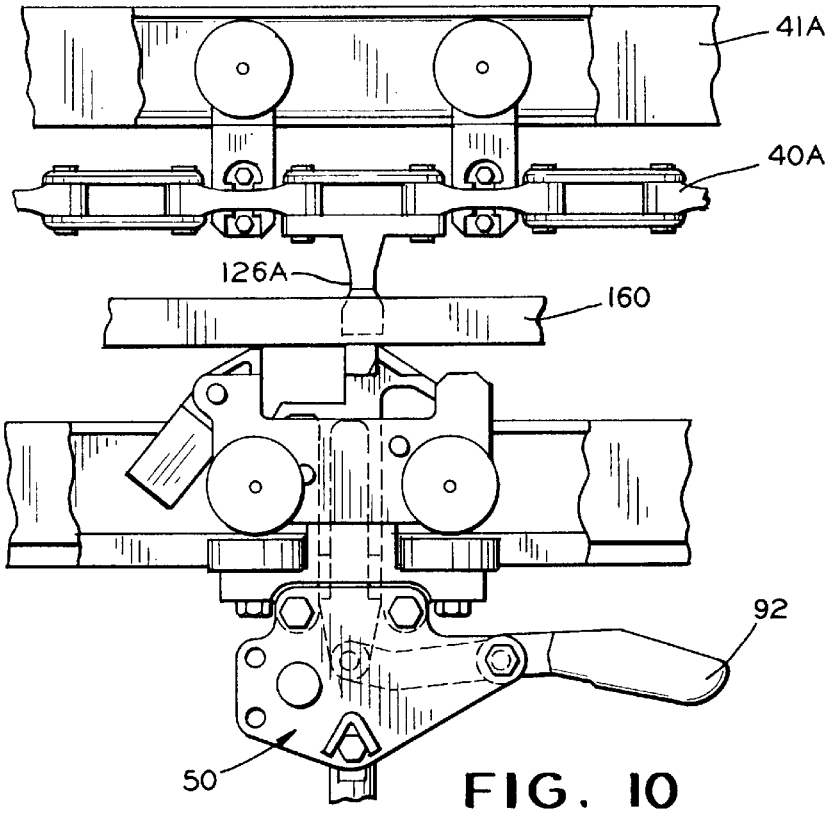
FIG. 10 is a fragmentary elevational view of the free trolley shown in FIG. 3 when it is at the position C indicated in FIG. 5.

Referring now to FIG. 10 (indicated at position C in FIG. 5), for ease of understanding the wipe out power trolley track 41B has been eliminated, but not the cam down bar 160. It can be seen at position C that the wipe in power trolley track 41A, and thus the wipe in pusher dog 126A, has wiped in over the top of the retractable wide dog 84 at an elevation 1" higher than the corresponding wipe out pusher dog 126B. Since the wipe in chain dog 126A comes in over the top of the adjustable wide dog 84 while it is being held down by the cam down bar 160, any possibility of a lateral interference is completely eliminated as long as the cam down bar 160 extends sufficiently to hold the wide dog 84 down past the interference zone.

Figure 11:
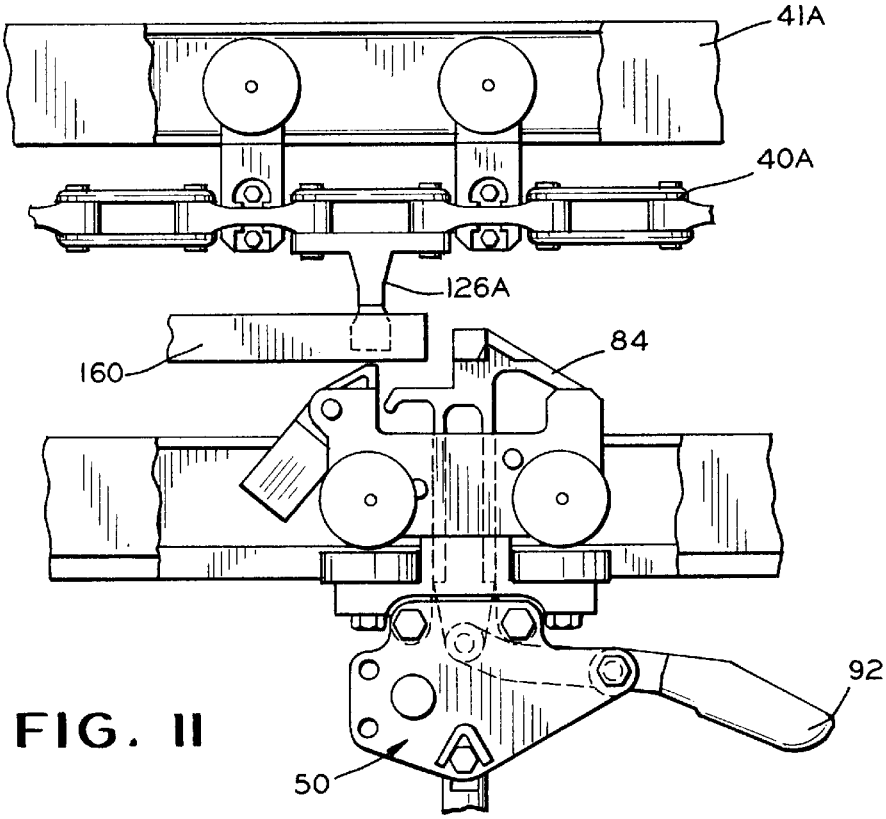
FIG. 11 is a fragmentary elevational view of the free trolley shown in FIG. 3 when it is at the position D indicated in FIG. 5.

Referring now to FIG. 11 (indicated at position D in FIG. 5) it can see that the free trolley 50 has been advanced by the wipe out pusher dog 126B (FIG. 5) to a position just past the end of the cam down bar 160, and the retractable wide dog, previously being held 1" below the position of its maximum extension, has raised up to its fully extended position ready to take a 1⅝" bite on the wipe in pusher dog 126A. When the wipe in pusher dog 126A returns to an elevation equal to that 6f the wipe out power dog (not shown for clarity); a full 1⅝" bite is achieved.

Figure 12:
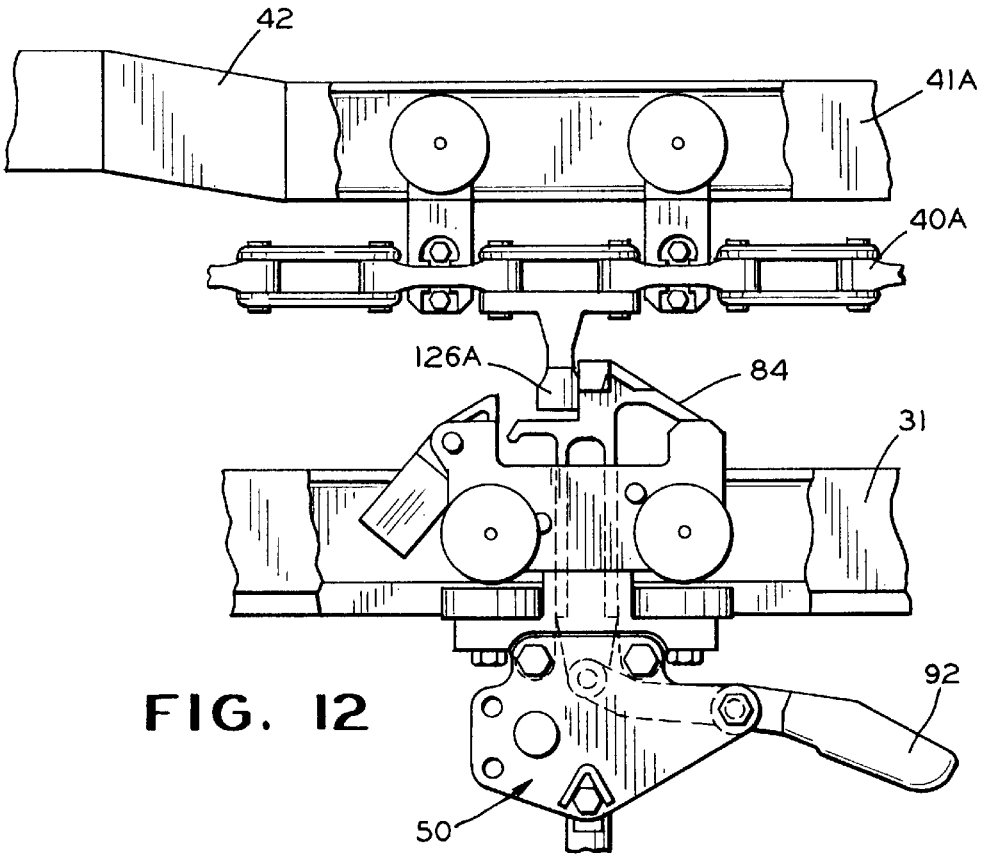
FIG. 12 is a fragmentary elevational view of the free trolley shown in FIG. 3 when it is at the position E indicated in FIG. 5.

Referring now to FIG. 12 (indicated at position E in FIG. 5) it can be seen that the wipe in power trolley track 41A has returned to its normal elevation through an decline section 42, and that the wipe in pusher dog 126A is again positioned to have a full 1⅝" bite on the retractable wide dog 84. It should be understood that this method of operation is possible because of the novel use of a much longer stroke for the retractable wide dog 84 than was heretofore thought possible in the industry. Before, to accomplish the ⅝" bite thought necessary for proper operation of a power and free conveyor system, it was necessary to use the approximately 1⅜" stroke previously available in the industry. It was thought to achieve any longer stroke of the retractable wide dog 84 would necessitate the use of an extremely large, and therefore unusable, counter weight 92. However, it has been found that the size of the counter weight did not have to be enlarged greatly to get the increased stroke which contributes to the novel method of operation of the present invention.

Figure 13:
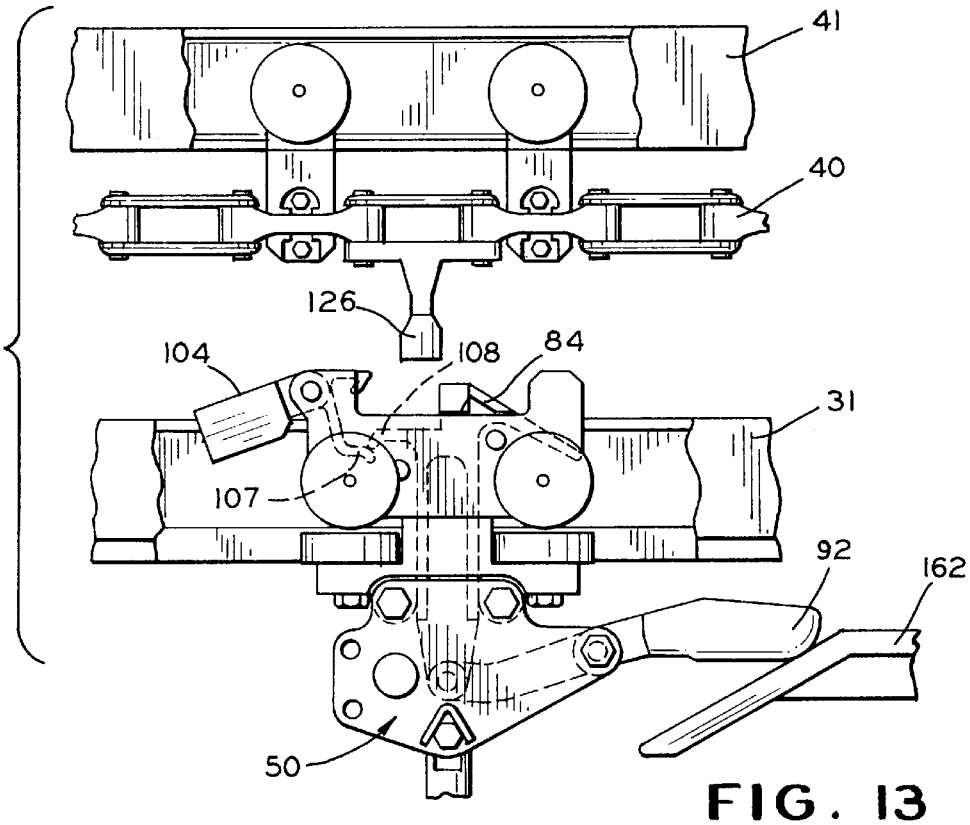
FIG. 13 is a fragmentary elevational view of the construction shown in FIG. 3 in its accumulating or fully retracted position.

FIG. 13 is a view of a leading free trolley 50 in its accumulating position. The counter weight 92 of the free trolley 50 has run up against an accumulating cam surface 162 (FIG. 2) and been lifted a sufficient distance to retract the retractable wide dog 84 to its fully retracted position. In this process the actuator flange 108 of the retractable dog 84 has come in contact with the actuation flange 107 of the hold back dog 104 and caused the hold back dog 104 to retract to a position wherein the cam surface 109 can no longer be contacted by the chain pusher dog 126, thus eliminating the noise generated by chain pusher dogs 126 constantly striking the holdback dog 104.

Since the pusher dog 126 can not contact either the hold back dog 104 or the retractable wide dog 84 the free trolley 50 and, thus, whatever is attached to it remains stationary until such time as the accumulating cam surface 162 attached to the trailing free trolley 50 moves forward, lowering the counter weight 92, and extending the retractable dog 84 to a position of "bite" with the pusher dog 126 at which time the free trolley 50 will resume movement.

Figure 14:
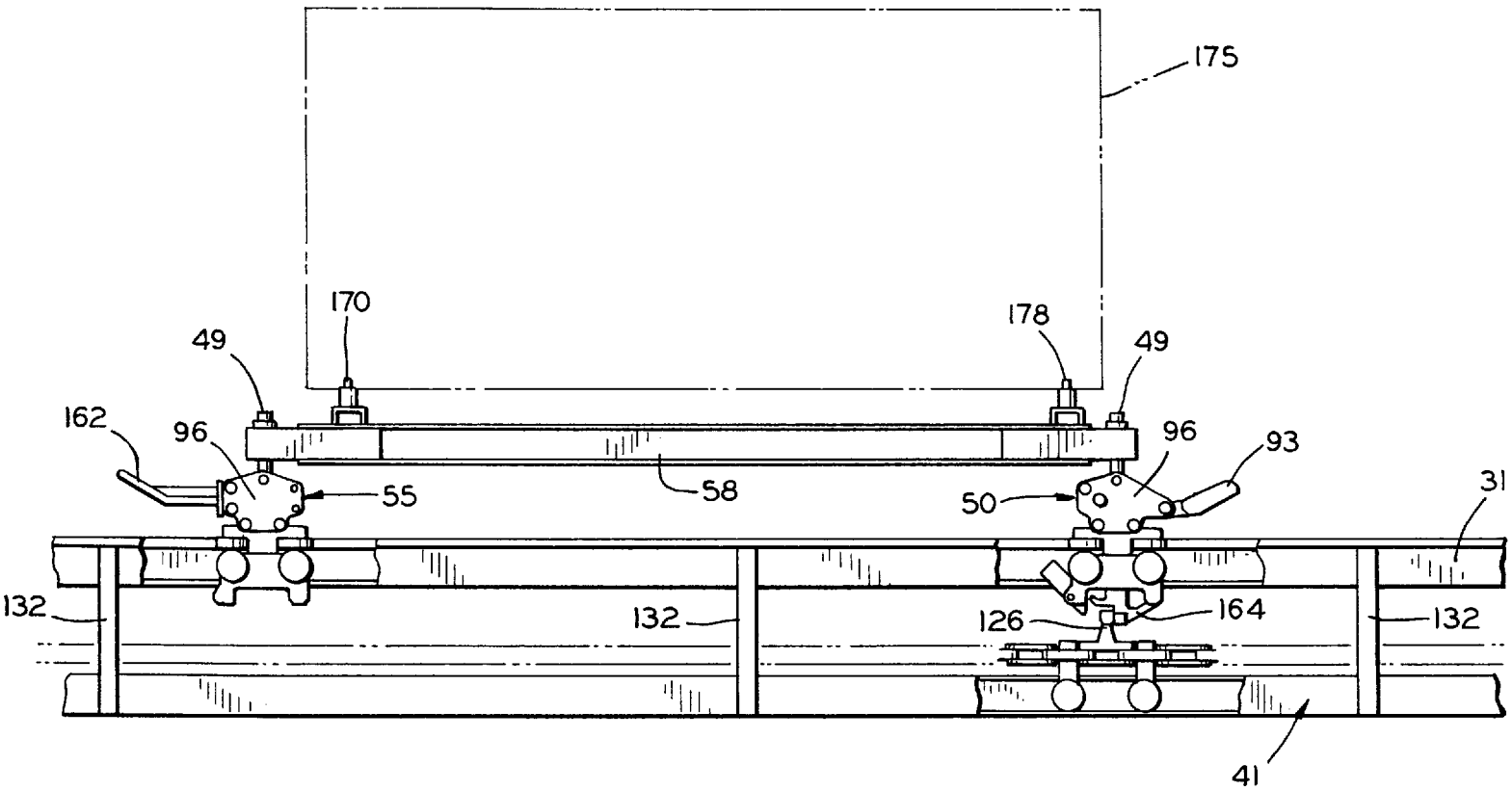
FIG. 14 is an elevational view of an inverted power and free conveyor embodying the construction of the present invention.

Referring now to FIG. 14 there is shown an example of how the present invention may be used in an inverted power and free conveyor system for transporting automobile bodies or other heavy objects. In this embodiment of the invention the free trolley track 31 is supported in an inverted position over the power trolley track 41 by the side support members 131, 132. The free trolley 50 is identical in most respects to the free trolley just described in the overhead power and free conveyor system. For stability the king pins 49 by which the load carrier 58 is affixed to the leading free trolley 50 and the trailing free trolley 55 are affixed to the side plates 96, 96A.

The elevations of the power trolley track 41 will vary at transfer and switch points just as previously discussed to avoid jamming conditions at such points. Also, the relative weights of the retractable wide dog 84 and the counter weight 92 previously used will be reversed. The retractable wide dog, while retaining all of the same functions of the retractable wide dog 84, will now be designated by the numeral 164, and will be made as heavy as possible, either by a change in shape, or a change in material, or both, to act as a counter weight and maintain itself in the fully extended position to take the 1⅝" bite on the chain pusher dog 126 as previously described.

It can be understood that when this is done with the retractable wide dog 164, it will be desirable that the actuating lever 93 be as light weight as possible so as to not to tend to retract the counter weight 164. However, the actuating lever 93 must still be strong enough to lift the counter weighted retractable wide dog 164 when it encounters the cam actuator 162 on a trailing free trolley 55. Pins 170 may be provided on the load carrier 58 to attach objects such as the load 175 to the carrier.

Figure 15:
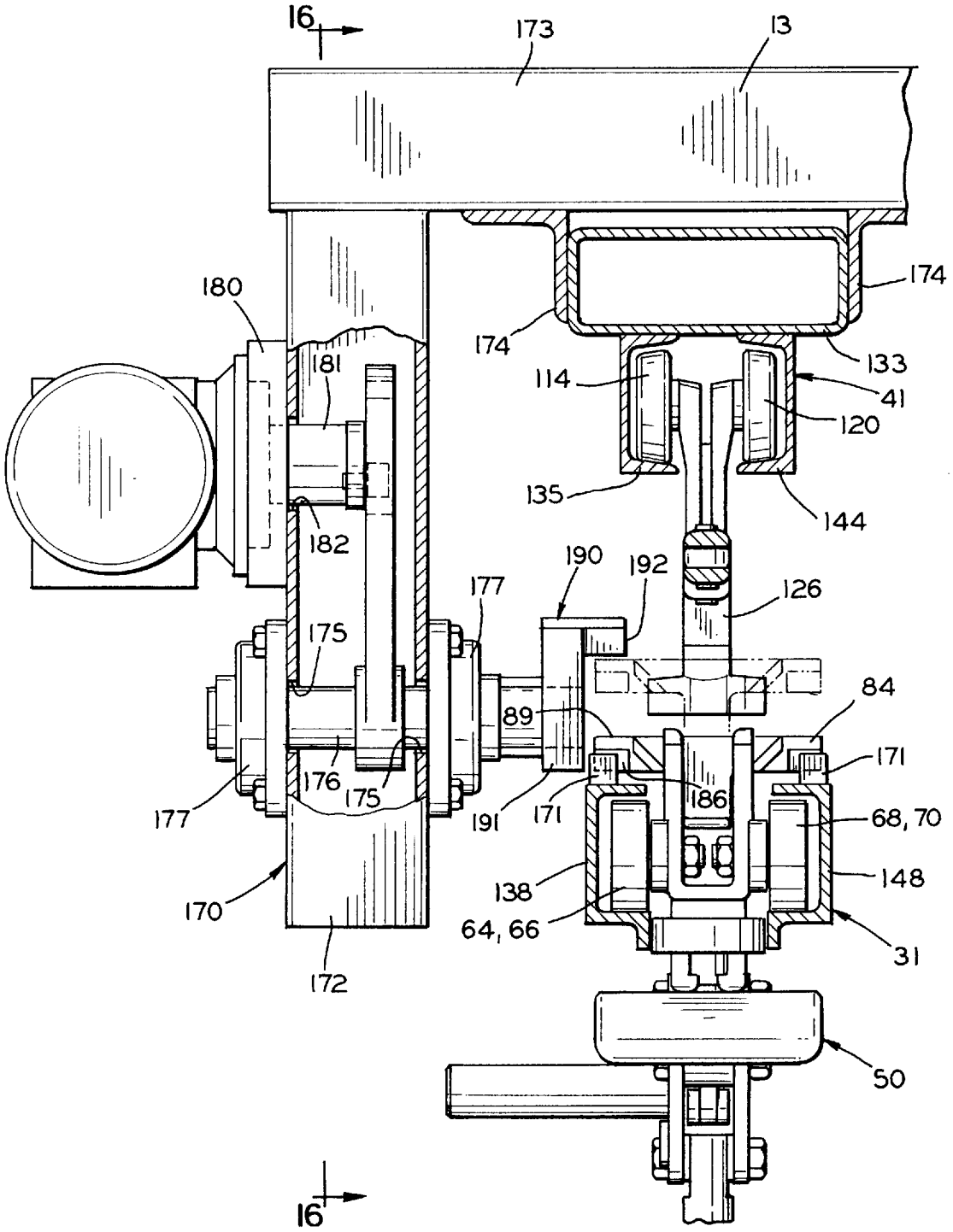
FIG. 15 is an end view of the stop means used in the present invention showing the stop member in the open, or released position.
Figure 16:
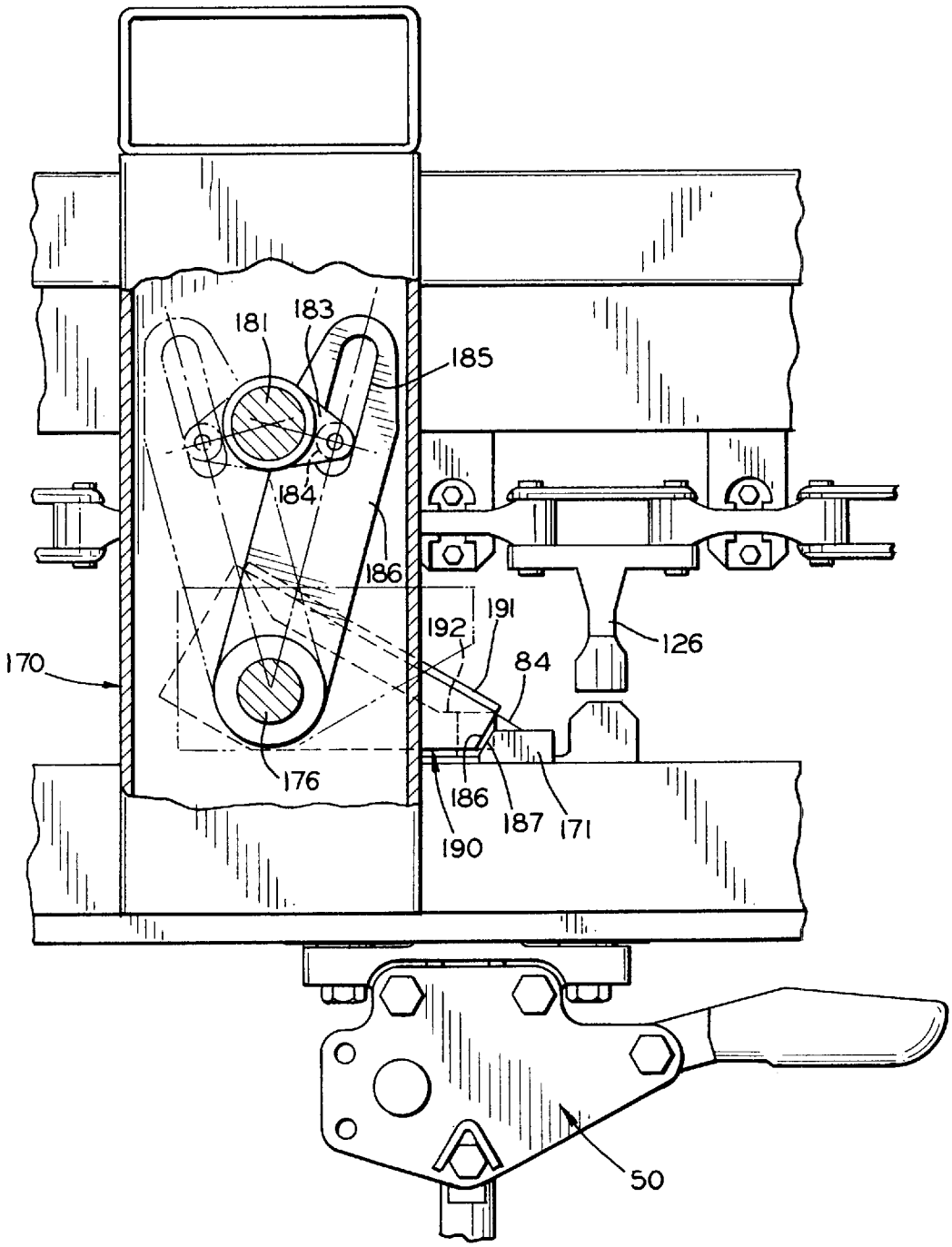
FIG. 16 is an elevational view of the stop means used in the construction of the present invention, showing the stop member in the closed, or blocked, position.

Referring to FIGS. 15 and 16, an improved stop means for stopping a free trolley at a work station is provided as part of the present invention. The stop means, generally indicated by the numeral 170, acts to stop a leading free trolley 50 at a desired position in alignment with a work station by rotating stop member 190 to its closed position, thereby lowering the retractable wide dog 84 to a position of interference with stops 171. The stops 171 are mounted in a transversely spaced and aligned relationship in a predetermined desired position to the first free track member 138 and the second free track member 148 forming a portion of the free trolley track 31. Rotating the stop member 190 to its open position will release the free trolley 50.

The stop means 170 includes a housing 172 mounted to a cross beam 173 secured to the upper support member 133 by suitable angles 134. The housing 172, cross beam 173, and angles 174 may be secured to the upper support member 133 by one or a combination of suitable means such as by welding or fasteners, etc. A pair of openings 175 are provided in the housing 172 in an axially positioned relationship to allow a shaft 176 to pass through. The shaft is securely held for rotation in bearings 177 and extends transversely of the housing 172.

Mounted above the bearing supports 177 on one side of the housing 172 is a geared reduction motor 180. A reduction motor shaft 181 passes through opening 182 in the housing. Fixedly mounted to the shaft 181 is a crank arm 183 having a cam roller 184 which reciprocates in the slot 185 which is provided in the lever 186 fixedly mounted to the shaft 176;.

The rotation of the reduction motor 180 will cause the movement of the lever 186 between the positions shown in solid lines and the position shown in phantom lines. Since the lever 186 is fixedly mounted to the shaft 176 the shaft 176 is constrained to rotate between a first position and a second position for the purpose to be explained hereinafter. Because of the right angle formed between the axis of the lever 186 and the crank arm 183, the arm 183 is "locked" in position, and upward force on the stop member will not cause rotation of the crank arm 183.

Mounted to the shaft 176 for rotation between first or open position and a closed or second position is a stop member generally designated by the numeral 190 and having a body portion 191 and an extension 192. The body portion 191 of the stop member 190 is positioned with relation to the free trolley track 31 so that the wing portion 89 of the wide dog 84 will not come in contact with the body portion 191 either in its open or closed position.

The dimensions of the stop member 190 and the extension member 192 are also chosen such that the extension member 192 will not contact the top of the wide dog 84 when it is in its open position, shown in phantom lines in FIG. 16.

When it is desired to stop the free trolley 50 at a station, means well known in the art such as cams, limit switches or other devices will cause the reduction motor 180 to operate, thus causing the shaft 181 to rotate the crank arm 183 and roller 184 to cause lever 186 to go to its second position, shown in solid lines in FIG. 16. This second or operative position has also caused the shaft 176 to rotate causing the stop member 190 to rotate to its closed position, shown in solids lines in FIG. 16.

As shown in FIG. 16 this is caused the extension portion 192 of the stop member 90 to come into contact with the top of the retractable wide dog 84, more specifically the wing portion 89 of the wide dog 84, and caused it to be lowered to its fully retracted position wherein the chain pusher dog 126 will pass over the top of it and cause the trolley 50 to come to a positive stop against the stops 171.

To avoid a possible problem where a wiping action was encountered between the retractable wide dog 84 and the stops 171, which could prevent the retractable wide dog 84 from again extending once the extension 192 ceased acting on the top of the dog, a beveled surface 186 is provided on both of the wing portions of the retractable wide dog 84 and on the front of the stops 171. By experimentation it has been found that an angle of 30° has eliminated all sticking problems between the wide dog 84 and the stops 171.

It will be understood by those skilled in the art that the improved stop member 190 of the present invention can be moved into the path of the free trolley 50 by other means, such as a lateral movement, with or without rotation, and this would be within the scope of the present invention.

Thus, by carefully analyzing problems occurring in present power and free conveyors, and especially problems occurring during transfers and stops, an improved power and free conveyor system is provided which eliminates the possibility of jamming during transfers.

What is claimed is:

1. In a power and free conveying system having a wipe in power chain, a wipe out power chain and a free track spaced vertically from both said wipe in power chain and said wipe out power chain and including a free trolley having a retractable dog supported on said free track for movement therealong, the improvement comprising:

a) the elevation of said wipe in power chain being sufficiently different from the elevation of said wipe out power chain during a switching or transfer operation to allow said wipe in power chain to wipe in over said free trolley without engaging said retractable dog of said free trolley.

2. The power and free conveyor system defined in claim 1, wherein said free trolley includes a hold back dog in addition to said retractable dog, and;

a) said wipe in power trolley track is positioned such that said wipe in power dog wipes in above said hold back dog and said retractable dog of said free trolley.

3. The power and free conveyor system defined in claim 2, wherein;

a) said retractable dog is a multi-position retractable wide dog having i) a fully extended position, ii) a cammed down position, and iii) a fully retracted position.

4. The power and free conveyor system defined in claim 3, wherein;

a) said retractable wide dog is guided within said free trolley by i) a front force guide roll, and ii) a rear force guide roll.

5. The power and free conveyor system defined in claim 4, wherein;

a) said retractable wide dog is held in said fully extended position by a counterweight connected thereto.

6. The power and free conveyor system defined in claim 5, wherein;

a) said counterweight allows said retractable wide dog to have a stroke of at least approximately 1⅝".

7. The power and free conveyor system defined in claim 6, whrein;

a) said holdback dog includes an actuation flange.

8. The power and free conveyor system defined in claim 1, wherein said power and free conveyor system is an inverted power and free conveyor system, and said wipe in power trolley track and said wipe out power trolley track are spaced below said free trolley track.

9. The power and free conveyor system defined in claim 8, wherein said free trolley includes a hold back dog in addition to said retractable dog, and;

a) said wipe in power trolley track is positioned such that said wipe in power dog wipes in below said hold back dog and said retractable dog of said free trolley.

10. The power and free conveyor system defined in claim 9, wherein;

a) said retractable dog is a multi-position retractable wide dog having i) a fully extended position, ii) a cammed down position, and iii) a fully retracted position.

11. The power and free conveyor system defined in claim 10, wherein;

a) said retractable wide dog is guided within said free trolley by i) a front force guide roll, and ii) a rear force guide roll.

12. The power and free conveyor system defined in claim 11, wherein;

a) said retractable wide dog has a predetermined weight for maintaining itself in a normally fully extended position.

13. The power and free conveyor system defined in claim 12 wherein;

a) said holdback dog includes an actuation flange.

14. In a power and free conveyor having at least one transfer portion, and including at said transfer portion a wipe in power chain having a wipe in dog, a wipe out power chain having a wipe out dog, and a free trolley having a multi-position retractable wide dog supported on a free track spaced vertically from said wipe in power chain and said wipe out power chain for movement along said free track when said free trolley is engaged by said wipe in power chain and or said wipe out power chain, the improvement comprising:

a) the elevation of said wipe in power chain at said transfer portion of said power and free conveyor being sufficiently different from the elevation of said wipe out power chain to allow said wipe in dog to wipe in over said retractable wide dog without engaging said power dog; said wipe in power chain travelling together with said wipe out power chain for a sufficient distance to effect a transfer.

15. The power and free conveyor system defined in claim 14, wherein said free trolley includes a hold back dog in addition to said retractable dog, and;

a) said wipe in power trolley track is positioned such that said wipe in power dog wipes in above said hold back dog and said retractable dog of said free trolley.

16. The power and free conveyor system defined in claim 15, wherein;

a) said retractable wide dog having i) a fully extended position, ii) a cammed down position, and iii) a fully retracted position.

17. The power and free conveyor system defined in claim 16, wherein;

a) said retractable wide dog is guided within said free trolley by i) a front force guide roll, and ii) a rear force guide roll.

18. The power and free conveyor system defined in claim 17, wherein;

a) said retractable wide dog is held in said fully extended position by a counterweight connected thereto.

19. The power and free conveyor system defined in claim 18, wherein;

a) said counterweight allows said retractable wide dog to have a stroke of at least approximately 1⅝".

20. The power and free conveyor system defined in claim 19, wherein;

a) said holdback dog includes an actuation flange.

21. The power and free conveyor system defined in claim 14, wherein said power and free conveyor system is an inverted power and free conveyor system and said wipe in power trolley track and said wipe out power trolley track are spaced vertically below said free trolley track.

22. The power and free conveyor system defined in claim 21, wherein said free trolley includes a hold back dog in addition to said retractable dog, and;

a) said wipe in power trolley track is positioned such that said wipe in power dog wipes in below said hold back dog and said retractable dog of said free trolley.

23. The power and free conveyor system defined in claim 22, wherein;

a) said retractable dog having i) a fully extended position, ii) a cammed down position, and iii) a fully retracted position.

24. The power and free conveyor system defined in claim 23, wherein;

a) said retractable wide dog is guided within said free trolley by i) a front force guide roll, and ii) a rear force guide roll.

25. The power and free conveyor system defined in claim 24, wherein;

a) said retractable dog has a predetermined weight for maintaining itself in a normally fully extended position.

26. The power and free conveyor system defined in claim 25, wherein;

a) said holdback dog includes an actuation flange.

27. In a power and free conveyor having at least one transfer portion, and including at the transfer portion a wipe in power chain having a wipe in power dog, a wipe out power chain having a wipe out power dog, and a free trolley having a multi-position retractable wide power dog supported on a free track spaced vertically from said wipe in power chain and said wipe out power chain for movement along said free track when said free trolley is engaged by said wipe in power chain and/or said wipe out power chain, the improvement comprising:

a) a cam down bar provided at said transfer portion of said power and free conveyor and acting on said wide dog to move said wide dog from a fully extended position to a cammed down position; and b) the elevation of said wipe in power chain at said transfer portion of said power and free conveyor being sufficiently different than the elevation of said wipe out power chain to allow said wipe in chain dog to wipe in over said retractable wide dog while said wide dog is in its cammed down position without engaging said dog, said wide dog moving to said fully extended position after passing out from under said cam down bar.

28. The power and free conveyor system defined in claim 27, wherein said free trolley includes a hold back dog in addition to said retractable dog, and;

a) said wipe in power trolley track is positioned such that said wipe in power dog wipes in above said hold back dog and said retractable dog of said free trolley.

29. The power and free conveyor system defined in claim 28, wherein;

a) said retractable dog having i) a fully extended position, ii) a cammed down position, and iii) a fully retracted position.

30. The power and free conveyor system defined in claim 29, wherein;

a) said retractable wide dog is guided within said free trolley by i) a front force guide roll, and ii) a rear force guide roll.

31. The power and free conveyor system defined in claim 30, wherein;

a) said retractable wide dog is held in said fully extended position by a counterweight connected thereto.

32. The power and free conveyor system defined in claim 31, wherein;

a) said counterweight allows said retractable wide dog to have a stroke of at least approximately 1⅝".

33. The power and free conveyor system defined in claim 32, wherein;

a) said holdback dog includes an actuation flange.

34. The power and free conveyor system defined in claim 27, wherein said power and free conveyor system is an inverted power and free conveyor system and said wipe in power trolley track and said wipe out power trolley track are spaced below said free trolley track.

35. The power and free conveyor system defined in claim 34, wherein said free trolley includes a hold back dog in addition to said retractable dog, and;

a) said wipe in power trolley track is positioned such that said wipe in power dog wipes in below said hold back dog and said retractable dog of said free trolley.

36. The power and free conveyor system defined in claim 35, wherein;

a) said retractable wide dog having i) a fully extended position, ii) a cammed down position, and iii) a fully retracted position.

37. The power and free conveyor system defined in claim 36, wherein;

a) said retractable wide dog is guided within said free trolley by i) a front force guide roll, and ii) a rear force guide roll.

38. The power and free conveyor system defined in claim 37, wherein;

a) said retractable wide dog has a predetermined weight for maintaining itself in a normally fully extended position.

39. The power and free conveyor system defined in claim 38, wherein;

a) said holdback dog includes an actuation flange.

40. A power and free conveying system including:

a) a wipe in power chain assembly including a wipe in chain dog;

b) a wipe out power chain assembly including a wipe out chain dog;

c) a free track assembly spaced vertically from said wipe out power chain assembly and said wipe in power chain assembly;

d) a free trolley supported on said free track assembly for movement there along; said free trolley including a retractable dog for engagement with said wipe in power chain and/or said wipe out power chain;

e) said retractable dog having a cammed down position where said dog only partially engages said wipe out chain dog while said retractable dog is traveling along said free track for a pre-determined distance while said wipe in power chain wipes into position over said retractable dog.

41. The power and free conveyor system defined in claim 40, wherein said free trolley includes a hold back dog in addition to said retractable dog, and;

a) said wipe in power trolley track is positioned such that said wipe in power dog wipes in above said hold back dog and said retractable dog of said free trolley.

42. The power and free conveyor system defined in claim 41, wherein;

a) said retractable dog is a multi-position retractable wide dog having i) a fully extended position, ii) a cammed down position, and iii) a fully retracted position.

43. The power and free conveyor system defined in claim 42, wherein;

a) said retractable wide dog is guided within said free trolley by i) a front force guide roll, and ii) a rear force guide roll.

44. The power and free conveyor system defined in claim 43, wherein;

a) said retractable wide dog is held in said fully extended position by a counterweight connected thereto.

45. The power and free conveyor system defined in claim 44, wherein;

a) said counterweight allows said retractable wide dog to have a stroke of at least approximately 1⅝".

46. The power and free conveyor system defined in claim 45, wherein;

a) said holdback dog includes an actuation flange.

47. The power and free conveyor system defined in claim 46, wherein said power and free conveyor system is an inverted power and free conveyor system and said wipe in power trolley track and said wipe out power trolley track are spaced vertically below said free trolley track.

48. The power and free conveyor system defined in claim 47, wherein said free trolley includes a hold back dog in addition to said retractable dog, and;

a) said wipe in power trolley track is positioned such that said wipe in power dog wipes in below said hold back dog and said retractable dog of said free trolley.

49. The power and free conveyor system defined in claim 48, wherein;

a) said retractable dog is a multi-position retractable wide dog having i) a fully extended position, ii) a cammed down position, and iii) a fully retracted position.

50. The power and free conveyor system defined in claim 49, wherein;

a) said retractable wide dog is guided within said free trolley by i) a front force guide roll, and ii) a rear force guide roll.

51. The power and free conveyor system defined in claim 50, wherein;

a) said retractable wide dog has a predetermined weight for maintaining itself in a normally fully extended position.

52. The power and free conveyor system defined in claim 51, wherein;

a) said holdback dog includes an actuation flange.

53. The device defined in claim 40, and further including:

a) a cam down bar at a transfer or switch portion of said power and free conveyor, said cam down bar acting on said retractable dog to move said retractable dog to its cammed down position; and b) the elevation of said wipe in chain being greater than the elevation of said wipe out chain proximate said cam down bar to allow said wipe in power chain to wipe in over said retractable dog while in its retracted position without engaging said retractable dog.

54. A power and free conveying system comprising:

a) a track assembly including a wipe in power track, a wipe out power track, and a free track spaced vertically from said power tracks;

b) a wipe in power trolley supported on said wipe in power track for movement there along;

c) a wipe out power trolley supported on said wipe out power track for movement there along;

d) a free trolley supported on said free track for movement there along, said free trolley including;

i) a moveable holdback dog engageable and disengageable with said wipe in power trolley and/or said wipe out power trolley, ii) a retractable dog having a first or fully extended position engageable with said wipe in power trolley or said wipe out power trolley, said retractable dog being held in said first or fully extended position by the action of a counter weight attached to said free trolley, a second or cammed down position wherein the elevation of said retractable dog is slightly greater than the elevation of said movable hold back dog, said retractable dog being held in said cammed down position when in an interference zone by a fixed, immovable, cam down bar, and a third or fully retracted position disengageable with said power trolley and engageable with said hold back dog to rotate said hold back dog and fully lower said free trolley to disengage said free trolley from said power trolley upon the said counter weight engaging another one of said free trolley, or a stop means;

e) the fixed, immovable cam down bar to hold said retractable dog in said cammed down position when said free trolley is in an interference zone, and f) a stop means for stoping said free trolley, said stop means being separate and distinct from said immovable cam down bar.

55. The power and free conveyor system defined in claim 54, wherein;

a) said wipe in power trolley track is positioned such that said wipe in power dog wipes in above said moveable hold back dog and said retractable dog of said free trolley.

56. The power and free conveyor system defined in claim 55, wherein;

a) said retractable wide dog is guided within said free trolley by i) a front force guide roll, and ii) a rear force guide roll.

57. The power and free conveyor system defined in claim 56, wherein;

a) said counterweight is of sufficient weight to allow said retractable wide dog to have a stroke of approximately 1⅝ inch.

58. The power and free conveyor system defined in claim 54, wherein said power and free conveyor system is an inverted power and free conveyor system and said wipe in power trolley track and said wipe out power trolley track are spaced below said free trolley track.

59. The power and free conveyor system defined in claim 58, wherein;

a) said wipe in power trolley track is positioned such that said wipe in power dog wipes in below said moveable hold back dog and said retractable dog of said free trolley.

60. The power and free conveyor system defined in claim 59, wherein;

a) said retractable wide dog is guided within said free trolley by i) a front force guide roll, and ii) a rear force guide roll.

61. The power and free conveyor system defined in claim 60, wherein;

a) said retractable wide dog has a predetermined weight to maintain itself in a fully extended position while permitting a stroke of at least approximately 1⅝".

62. The power and free conveyor system defined in claim 61, wherein;

a) said holdback dog includes an actuation flange.

63. The power and free conveyor system defined in claim 58, wherein said free trolley includes a hold back dog in addition to said retractable dog; and;

a) said wipe in power trolley track is positioned such that said wipe in power dog wipes in below said hold back dog and said retractable dog of said free trolley.

64. In a power and free conveyor of the type having at least one switch, and including at the switch a wipe in power chain having a wipe in pusher dog, a wipe out power chain having a wipe out pusher dog, and a free trolley having a retractable wide dog supported on a free track spaced vertically from said wipe in power chain and said wipe out power chain, the improvement comprising:

a) a cam down bar provided proximate said switch and acting on said retractable wide dog to move said retractable wide dog from a fully extended position to a cammed down position; and b) the elevation of said wipe in power chain at said transfer portion of said power and free conveyor being sufficiently different than the elevation of said wipe out power chain to allow said wipe in chain dog to wipe in over said retractable wide dog while said wide dog is in its cammed down position without engaging said wide dog, said wide dog moving to its fully extended position after passing out from under said cam bar.

65. The power and free conveyor system defined in claim 64, wherein said free trolley includes a hold back dog in addition to said retractable dog, and;

a) said wipe in power trolley track is positioned such that said wipe in power dog wipes in above said hold back dog and said retractable dog of said free trolley.

66. The power and free conveyor system defined in claim 65, wherein;

a) said retractable dog is a multi-position retractable wide dog having
i) a fully extended position,
ii) a cammed down position, and
iii) a fully retracted position.

67. The power and free conveyor system defined in claim 66, wherein;

a) said retractable wide dog is guided within said free trolley by
i) a front force guide roll, and
ii) a rear force guide roll.

68. The power and free conveyor system defined in claim 67, wherein;

a) said retractable wide dog is held in said fully extended position by a counterweight connected thereto.

69. The power and free conveyor system defined in claim 68, wherein;

a) said counterweight allows said retractable wide dog to have a stroke of at least approximately 1⅝".

70. The power and free conveyor system defined in claim 69, wherein;

a) said holdback dog includes an actuation flange.

71. The power and free conveyor system defined in claim 64, wherein said power and free conveyor system is an inverted power and free conveyor system and said wipe in power trolley track and said wipe out power trolley track are spaced below said free trolley track.

72. The power and free conveyor system defined in claim 71, wherein said free trolley includes a hold back dog in addition to said retractable dog, and;

a) said wipe in power trolley track is positioned such that said wipe in power dog wipes in below said hold back dog and said retractable dog of said free trolley.

73. The power and free conveyor system defined in claim 72, wherein;

a) said retractable dog is a multi-position retractable wide dog having
i) a fully extended position,
ii) a cammed down position, and
iii) a fully retracted position.

74. The power and free conveyor system defined in claim 73, wherein;

a) said retractable wide dog is guided within said free trolley by
i) a front force guide roll, and
ii) a rear force guide roll.

75. The power and free conveyor system defined in claim 74, wherein;

a) said retractable wide dog has a predetermined weight for maintaining itself in a normally fully extended position.

76. A method of transferring a free trolley from engagement with a wipe out power dog in a power and free conveyor system to a wipe in power dog without jamming conditions said method including the steps of:

a) providing a cammed down bar proximate the point of transfer to move a retractable dog on said free trolley to a cammed down position while;

b) providing that the wipe in power chain is at a position higher than the wipe out power chain for at least the zone where lateral interference between the wipe in power chain and the retractable dog could occur; and c) returning the elevation of the wipe in power chain to the elevation of the wipe out power chain after the interference zone.

* * * * *